US009724956B2

(12) United States Patent
Schmid et al.

(10) Patent No.: US 9,724,956 B2
(45) Date of Patent: Aug. 8, 2017

(54) OPTICAL EFFECT LAYERS SHOWING A VIEWING ANGLE DEPENDENT OPTICAL EFFECT; PROCESSES AND DEVICES FOR THEIR PRODUCTION; ITEMS CARRYING AN OPTICAL EFFECT LAYER; AND USES THEREOF

(71) Applicant: SICPA HOLDING SA, Prilly (CH)

(72) Inventors: Mathieu Schmid, Lausanne (CH); Evgeny Loginov, Renens (CH); Claude Alain Despland, Prilly (CH); Pierre Degott, Crissier (CH)

(73) Assignee: SICPA HOLDING SA, Prilly (CH)

( * ) Notice: Subject to any disclaimer, the term of this patent is extended or adjusted under 35 U.S.C. 154(b) by 0 days.

(21) Appl. No.: 14/759,831

(22) PCT Filed: Jan. 7, 2014

(86) PCT No.: PCT/EP2014/050161
§ 371 (c)(1),
(2) Date: Jul. 8, 2015

(87) PCT Pub. No.: WO2014/108404
PCT Pub. Date: Jul. 17, 2014

(65) Prior Publication Data

US 2015/0352888 A1 Dec. 10, 2015

(30) Foreign Application Priority Data

Jan. 9, 2013 (EP) ..... 13150694

(51) Int. Cl.
*H01F 41/16* (2006.01)
*B42D 25/369* (2014.01)
(Continued)

(52) U.S. Cl.
CPC ..... *B42D 25/369* (2014.10); *B05D 3/20* (2013.01); *B05D 3/207* (2013.01); *B41M 3/148* (2013.01);
(Continued)

(58) Field of Classification Search
None
See application file for complete search history.

(56) References Cited

U.S. PATENT DOCUMENTS 2,570,856 A 10/1951 Carlton et al.
3,676,273 A 7/1972 Graves
(Continued)

FOREIGN PATENT DOCUMENTS

BE 678 945 10/1966
CN 101069881 11/2007
(Continued)

OTHER PUBLICATIONS

John Wiley & Sons, "Chemistry & Technology of UV & EB Formulation for Coatings, Inks & Paints", Published in 7 Volumes in association with SITA Technology Limited, 1997-1998, PP.
(Continued)

*Primary Examiner* — Kevin Bernatz
(74) *Attorney, Agent, or Firm* — Greenblum & Bernstein, P.L.C.

(57) ABSTRACT

The invention relates to the field of the protection of security documents such as for example banknotes and identity documents against counterfeit and illegal reproduction. In particular, the invention relates to optical effect layers (OEL) showing a viewing-angle dependent optical effect, devices and processes for producing said OEL and items carrying said OEL, as well as uses of said optical effect layers as an anti-counterfeit means on documents. The OEL comprises a plurality of non-spherical magnetic or magnetizable par-
(Continued)

ticles, which are dispersed in a coating composition comprising a binder material, wherein in at least a loop-shaped area of the OEL at least a part of the plurality of non-spherical magnetic or magnetizable particles are oriented such that their longest axis is substantially parallel to the plane of the OEL, and wherein, in a cross-section perpendicular to the OEL and extending from the center of the central area, the longest axis of the oriented particles present in the loop-shaped area forming the impression of the loop-shaped body follow a tangent of either a negatively curved or a positively curved part of a hypothetical ellipse or circle.

19 Claims, 10 Drawing Sheets

(51) Int. Cl.

| | |
|---|---|
| ***G07D 7/00*** | (2016.01) |
| ***B44F 1/10*** | (2006.01) |
| ***B05D 3/00*** | (2006.01) |
| ***B41M 3/14*** | (2006.01) |
| ***B42D 25/29*** | (2014.01) |
| ***H01F 7/02*** | (2006.01) |

(52) U.S. Cl.
CPC ..... *B42D 25/29* (2014.10); *B44F 1/10* (2013.01); *G07D 7/0006* (2013.01); *H01F 7/0273* (2013.01); *H01F 41/16* (2013.01); *B42D 2033/16* (2013.01); *B42D 2033/20* (2013.01); *B42D 2035/20* (2013.01)

(56) References Cited

U.S. PATENT DOCUMENTS

| | | | | |
|---|---|---|---|---|
| 3,791,864 | A | 2/1974 | Steingroever | |
| 4,838,648 | A | 6/1989 | Phillips et al. | |
| 5,364,689 | A * | 11/1994 | Kashiwagi | B05D 3/207 359/296 |
| 5,630,877 | A | 5/1997 | Kashiwagi et al. | |
| 6,114,018 | A * | 9/2000 | Phillips | B05D 1/286 428/200 |
| 6,410,130 | B1 | 6/2002 | Schuhmacher et al. | |
| 6,531,221 | B1 | 3/2003 | Schuhmacher et al. | |
| 6,582,781 | B1 | 6/2003 | Schuhmacher et al. | |
| 6,838,166 | B2 | 1/2005 | Phillips et al. | |
| 7,604,855 | B2 * | 10/2009 | Raksha | B05D 3/207 283/72 |
| 9,102,195 | B2 * | 8/2015 | Raksha | B41M 7/0072 |
| 9,248,637 | B2 * | 2/2016 | Bargir | B41F 11/02 |
| 2005/0106367 | A1 | 5/2005 | Raksha et al. | |
| 2006/0097515 | A1 | 5/2006 | Raksha et al. | |
| 2006/0198998 | A1 * | 9/2006 | Raksha | G02B 5/09 428/323 |
| 2007/0172261 | A1 | 7/2007 | Raksha et al. | |
| 2007/0237891 | A1 | 10/2007 | Sugiura et al. | |
| 2008/0073613 | A1 | 3/2008 | Sugiura et al. | |
| 2008/0213516 | A1 * | 9/2008 | Wild | B05D 5/065 428/29 |
| 2009/0200791 | A1 * | 8/2009 | Despland | B44F 7/00 283/85 |
| 2011/0168088 | A1 | 7/2011 | Raksha et al. | |
| 2011/0290129 | A1 * | 12/2011 | Gygi | B41M 3/14 101/150 |
| 2012/0205905 | A1 * | 8/2012 | Degott | B41M 3/148 283/72 |
| 2013/0087060 | A1 | 4/2013 | Raksha et al. | |
| 2014/0077485 | A1 * | 3/2014 | Raksha | B41M 7/0072 283/67 |
| 2015/0352883 | A1 * | 12/2015 | Schmid | B05D 3/20 283/73 |

FOREIGN PATENT DOCUMENTS

| | | |
|---|---|---|
| EP | 0 556 449 | 8/1993 |
| EP | 0 686 675 | 12/1995 |
| EP | 1 710 756 | 10/2006 |
| EP | 1 842 883 | 10/2007 |
| EP | 1 845 537 | 10/2007 |
| EP | 2 087 943 | 8/2009 |
| GB | 1131038 | 10/1968 |
| WO | 02/073250 | 9/2002 |
| WO | 2002/090002 | 11/2002 |
| WO | 03/000801 | 1/2003 |
| WO | 2005/002866 | 1/2005 |
| WO | 2006/063926 | 6/2006 |
| WO | 2006/069218 | 6/2006 |
| WO | 2007/131833 | 11/2007 |
| WO | 2008/046702 | 4/2008 |
| WO | 2010/058026 | 5/2010 |
| WO | 2011/092502 | 8/2011 |

OTHER PUBLICATIONS

J.M. Adams et al., "Printing Technology ", Delmar Thomson Learning, 5th Edition, , PP.

Int'l Search Report conducted in PCT/EP2014/050161 (Oct. 14, 2014).

Written Opinion of Int'l Searching Auth. in PCT/EP2014/050161 (Jul. 9, 2015).

China Office Action conducted in counterpart China Appln. No. 2014800041599 (Aug. 2, 106) (with English language translation).

* cited by examiner

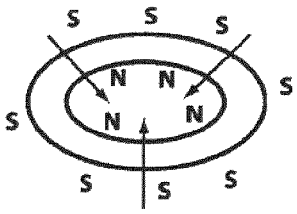
Figure 6A
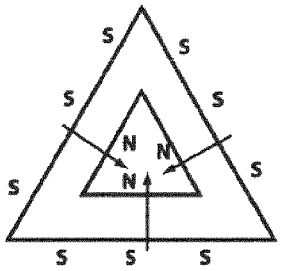
Figure 6B
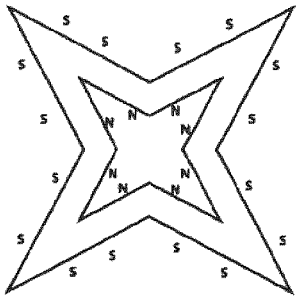
Figure 6C
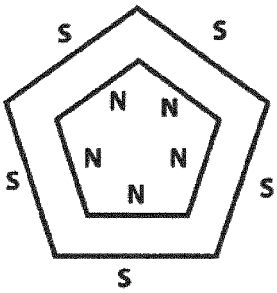
Figure 6D
Figure 6

OPTICAL EFFECT LAYERS SHOWING A VIEWING ANGLE DEPENDENT OPTICAL EFFECT; PROCESSES AND DEVICES FOR THEIR PRODUCTION; ITEMS CARRYING AN OPTICAL EFFECT LAYER; AND USES THEREOF

FIELD OF THE INVENTION

The present invention relates to the field of the protection of value documents and value commercial goods against counterfeit and illegal reproduction. In particular, the present invention relates to optical effect layers (OEL) showing a viewing-angle dependent optical effect, devices and processes for producing said OEL and items carrying said OEL, as well as uses of said optical effect layers as an anti-counterfeit means on documents.

BACKGROUND OF THE INVENTION

It is known in the art to use inks, compositions or layers containing oriented magnetic or magnetizable particles or pigments, particularly also magnetic optically variable pigments, for the production of security elements, e.g. in the field of security documents. Coatings or layers comprising oriented magnetic or magnetizable particles are disclosed for example in U.S. Pat. No. 2,570,856; U.S. Pat. No. 3,676,273; U.S. Pat. No. 3,791,864; U.S. Pat. No. 5,630,877 and U.S. Pat. No. 5,364,689. Coatings or layers comprising oriented magnetic color-shifting pigment particles, resulting in particularly appealing optical effects, useful for the protection of security documents, have been disclosed in WO 2002/090002 A2 and WO 2005/002866 A1.

Security features, e.g. for security documents, can generally be classified into "covert" security features one the one hand, and "overt" security features on the other hand. The protection provided by covert security features relies on the concept that such features are difficult to detect, typically requiring specialized equipment and knowledge for detection, whereas "overt" security features rely on the concept of being easily detectable with the unaided human senses, e.g. such features may be visible and/or detectable via the tactile senses while still being difficult to produce and/or to copy. However, the effectiveness of overt security features depends to a great extent on their easy recognition as a security feature, because most users, and particularly those having no prior knowledge of the security features of a therewith secured document or item, will only then actually perform a security check based on said security feature if they have actual knowledge of their existence and nature.

A particularly striking optical effect can be achieved if a security feature changes its appearance in view to a change in viewing conditions, such as the viewing angle. Such an effect can e.g. by obtained by dynamic appearance-changing optical devices (DACODs), such as concave, respectively convex Fresnel type reflecting surfaces relying on oriented pigment particles in a hardened coating layer, as disclosed in EP-A 1 710 756. This document describes one way to obtain a printed image that contains pigments or flakes having magnetic properties by aligning the pigments in a magnetic field. The pigments or flakes, after their alignment in a magnetic field, show a Fresnel structure arrangement, such as a Fresnel reflector. By tilting the image and thereby changing the direction of reflection towards a viewer, the area showing the greatest reflection to the viewer moves according to the alignment of the flakes or pigments. One example of such a structure is the so-called "rolling bar" effect. This effect is nowadays utilized for a number of security elements on banknotes, such as on the "50" of the 50 Rand banknote of South Africa. However, such rolling bar effects are generally observable if the security document is tilted in a certain direction, i.e. either up and down or sideways from the viewer's perspective While the Fresnel type reflecting surfaces are flat, they provide the appearance of a concave or convex reflecting hemisphere. Said Fresnel type reflecting surfaces can be produced by exposing a wet coating layer comprising non-isotropically reflecting magnetic or magnetizable particles to the magnetic field of a single dipole magnet, wherein the latter is disposed above, respectively below the plane of the coating layer, has its north-south axis parallel to said plane, and is rotating around the axis perpendicular to said plane, as illustrated in FIGS. 37A-37D of EP-A 1 710 756. The so-oriented particles are consequently fixed in position and orientation by hardening the coating layer.

Moving-ring images displaying an apparently moving ring with changing viewing angle ("rolling ring" effect) are produced by exposing a wet coating layer comprising non-isotropically reflecting magnetic or magnetizable particles to the magnetic field of a dipole magnet WO 2011/092502 discloses moving-ring images that might be obtained or produced by using a device for orienting particles in a coating layer. The disclosed device allows the orientation of magnetic or magnetizable particles with the help of a magnetic field produced by the combination of a soft magnetizable sheet and a spherical magnet having its North-South axis perpendicular to the plane of the coating layer and disposed below said soft magnetizable sheet. The prior art moving ring images are generally produced by alignment of the magnetic or magnetizable particles according to the magnetic field of only one rotating or static magnet. Since the field lines of only one magnet generally bend relatively softly, i.e. have a low curvature, also the change in orientation of the magnetic or magnetizable particles is relatively soft over the surface of the OEL. Further, the intensity of the magnetic field decreases rapidly with increasing distance from the magnet when only a single magnet is used. This makes it difficult to obtain a highly dynamic and well-defined feature through orientation of the magnetic or magnetizable particles, and may result in "rolling ring" effects that exhibit blurred ring edges. This problem increases with increasing size (diameter) of the "rolling ring" image when only a single static or rotating magnet is used.

Therefore, a need remains for security features displaying an eye-catching dynamic loop-shaped effect covering an extended area on a document in good quality, which can be easily verified regardless of the orientation of the security document, is difficult to produce on a mass-scale with the equipment available to a counterfeiter, and which can be provided in great number of possible shapes and forms.

SUMMARY OF THE INVENTION

Accordingly, it is an object of the present invention to overcome the deficiencies of the prior art as discussed above. This is achieved by the provision of an optical effect layer, e.g. on a document or other item, which exhibits a viewing-angle dependent apparent motion of image features over an extended length, has good sharpness and/or contrast, and which can be easily detected. The present invention provides such optical effect layers as an improved easy-to-detect overt security feature, or, in addition or alternatively, as a covert security feature, e.g. in the field of document security.

There are disclosed and claimed herein optical effect layers (OELs) comprising a security element and security documents comprising said optical effect layers. Specifically, an optical effect layer (OEL) is provided, comprising a plurality of non-spherical magnetic or magnetizable particles, which are dispersed in a coating composition comprising a binder material, wherein in at least a loop-shaped area of the OEL at least a part of the plurality of non-spherical magnetic or magnetizable particles are oriented such that their longest axis is substantially parallel to the plane of the OEL, said loop-shaped area forming an optical impression of a loop-shaped body surrounding a central area, wherein, in a cross-section perpendicular to the OEL and extending from the centre of the central area, the longest axis of the oriented particles present in the loop-shaped area follow a tangent of either a negatively curved or a positively curved part of a hypothetical ellipse or circle. By the orientation of the non-spherical magnetic or magnetizable particles in this way, the optical effect of a loop-shaped body is generated to a viewer.

Also described and claimed therein are magnetic-field-generating devices which can be used for producing the optical effect layers described herein. Specifically, a magnetic-field-generating device for forming an optical effect layer is provided, said device being configured for receiving a coating composition comprising a plurality of non-spherical magnetic or magnetizable particles and a binder material, and comprising one or more magnets configured for orienting at least a part of the plurality of non-spherical magnetic or magnetizable particles in parallel to the plane of the optical effect layer in at least a loop-shaped area thereof, said loop-shaped area forming an optical impression of a closed loop-shaped body surrounding a central area, wherein, in a cross-section perpendicular to the OEL and extending from the centre of the central area, the longest axis of the oriented particles present in the loop-shaped area forming the optical impression of the loop-shaped body follow a tangent of either a negatively curved or a positively curved part of a hypothetical ellipse or circle. The coating composition can be applied directly to a supporting surface which is part of the device and formed by a solid member (such as a plate) or to a substrate provided on such a supporting surface, or alternatively the substrate can take the role of a supporting surface for the coating composition.

Also described and claimed herein are processes for producing the security element, the optical effect layers comprising it and uses of the optical effect layers for the counterfeit-protection of a security document or for a decorative application in the graphic arts. Specifically, the present invention pertains to a process for producing an optical effect layer (OEL) comprising the steps of:

a) applying on a substrate surface or on a supporting surface of a magnetic-field-generating device a coating composition comprising a binder and a plurality of non-spherical magnetic or magnetizable particles, said coating composition being in a first (fluid) state, b) exposing the coating composition in a first state to the magnetic field of a magnetic-field-generating device, preferably one as defined in any of claims 8 to 12, thereby orienting at least a part of the non-spherical magnetic or magnetizable particles in at least a loop-shaped area surrounding one central area such that, in a cross-section perpendicular to the OEL and extending from the center of the central area, the longest axis of the particles present in the loop-shaped area follow a tangent of either a negatively curved or a positively curved part of a hypothetical ellipse or circle, and c) hardening the coating composition to a second state so as to fix the magnetic or magnetizable non-spherical particles in their adopted positions and orientations.

Further preferred embodiments and aspects of the present invention will become apparent in view of the dependent claims and the following description.

Several aspects of the present invention can be summarized as follows:

1. An optical effect layer (OEL) comprising a plurality of non-spherical magnetic or magnetizable particles, which are dispersed in a coating composition comprising a binder material,
   wherein in at least a loop-shaped area of the OEL at least a part of the plurality of non-spherical magnetic or magnetizable particles are oriented such that their longest axis is substantially parallel to the plane of the OEL, said loop-shaped area forming the optical impression of a closed loop-shaped body surrounding a central area, wherein, in a cross-section perpendicular to the OEL and extending from the centre of the central area, the longest axis of the oriented particles present in the loop-shaped area forming the impression of the loop-shaped body follow a tangent of either a negatively curved or a positively curved part of a hypothetical ellipse or circle.
2. The optical effect layer (OEL) according to item 1, wherein the OEL comprises an external area outside the closed loop-shaped area, and the external area surrounding the loop-shaped area comprises a plurality of non-spherical magnetic or magnetizable particles, wherein a part of the plurality of non-spherical magnetic or magnetizable particles within the external area are oriented such that their longest axis is substantially perpendicular to the plane of the OEL or randomly oriented.
3. The optical effect layer (OEL) according to item 1 or 2, wherein the central area surrounded by the loop-shaped area comprises a plurality of non-spherical magnetic or magnetizable particles, wherein a part of the plurality of non-spherical magnetic or magnetizable particles within the central area are oriented such that their longest axis is substantially parallel to the plane of the OEL, forming the optical effect of a protrusion within the central area of the loop-shaped body.
4. The optical effect layer (OEL) according to item 3, wherein at least a part of the outer peripheral shape of the protrusion is similar to the shape of the loop-shaped body.
5. The optical effect layer (OEL) according to item 4, wherein the loop-shaped body has the form of a ring, and the protrusion has the shape of a solid circle or a half-sphere.
6. The optical effect layer (OEL) according to any preceding item, wherein at least a part of the plurality of non-spherical magnetic or magnetizable particles is constituted by comprise non-spherical optically variable magnetic or magnetizable pigments.
7. The optical effect layer (OEL) according to item 6, wherein the non-spherical optically variable magnetic or magnetizable pigments are selected from the group consisting of magnetic thin-film interference pigments, magnetic cholesteric liquid crystal pigments and mixtures thereof.
8. A magnetic-field-generating device for forming an optical effect layer, said device being configured for receiving a coating composition comprising a plurality of non-spherical magnetic or magnetizable particles and a binder material, and comprising one or more magnets configured for orienting at least a part of the plurality of non-spherical magnetic or magnetizable particles in parallel to the plane of the optical effect layer in at least a loop-shaped area thereof, said loop-shaped area forming the optical impression of a closed loop-shaped body surrounding a central area, wherein, in a cross-section perpendicular to the OEL and extending from the centre of the central area, the longest axis of the oriented particles present in the loop-shaped area forming the impression of the loop-shaped body follow a tangent of either a negatively curved or a positively curved part of a hypothetical ellipse or circle.

9. The magnetic-field-generating device according to item 8, which either
   a) comprises a supporting surface for receiving the coating composition, and the supporting surface is formed by
   a1) a plate on which the coating composition can be applied directly,
   a2) a plate for receiving a substrate on which the coating composition can be applied, or
   a3) a surface of a magnet on which the coating composition can be applied directly, or above or on which a substrate on which the coating composition can be applied can be provided; or
   b) is configured for receiving a substrate on which the optical effect layer is to be provided, said substrate replacing the supporting surface.

10. The magnetic-field-generating device according to item 9, said device comprising a supporting surface or being configured to receive a substrate replacing the supporting surface, the device further comprising either
   a) a bar dipole magnet arranged below the supporting surface or the substrate replacing the supporting surface and having its North-South axis perpendicular to the supporting surface/the substrate surface, and a pole piece, wherein
      a1) the pole piece is disposed below the bar dipole magnet and in contact with one of the poles of the magnet, and/or
      a2) wherein the pole piece is spaced apart from and laterally surrounds the bar dipole magnet;
   b) one or more pairs of bar dipole magnets below the supporting surface and rotatable around an axis of rotation that is substantially perpendicular to the supporting surface, said magnets having their North-South axis substantially parallel to the supporting surface and their magnetic North-South axis substantially radial with respect to the axis of rotation and
      b1) opposite magnetic North-South directions, or
      b2) the same magnetic North-South direction
      the one or more pairs being each formed by two bar dipole magnets that are located substantially symmetrically about the axis of rotation;
   c) one or more pairs of bar dipole magnets below the supporting surface and rotatable around an axis of rotation that is substantially perpendicular to the supporting surface, said magnets having i) their North-South axis substantially perpendicular to the supporting surface, ii) their magnetic North-South axis substantially parallel to the axis of rotation, and iii) opposite magnetic North-South directions, the one or more pairs each consisting of assemblies of two bar dipole magnets being symmetrically disposed about the axis of rotation;
   d) three bar dipole magnets below the supporting surface and provided rotatable around an axis of rotation that is substantially perpendicular to the supporting surface, wherein two of the three bar dipole magnets are located on opposite sides and about the axis of rotation, and the third bar dipole magnet is positioned on the axis of rotation, and wherein i) each of the magnets has its North-South axis substantially parallel to the supporting surface, ii) the two magnets spaced apart from the axis of rotation have their North-South axis substantially radial with respect to the axis of rotation, iii) the two bar dipole magnets spaced apart from the axis of rotation have the same North-South directions, i.e. asymmetric with respect to the axis of rotation, and iv) the third bar dipole magnet on the axis of rotation has a North-South direction opposite to the North-South direction of the two bar dipole magnets spaced apart;
   e) a dipole magnet below the supporting surface or the substrate replacing the supporting surface, the dipole magnet consisting of a loop-shaped body, said magnet having its magnetic North-South axis radially extending from the center of the loop-shaped body to the periphery;
   f) one or more bar dipole magnets below the supporting surface or the substrate replacing the supporting surface and rotatable about an axis of rotation that is substantially perpendicular to the supporting surface/the substrate surface, each of the one or more bar dipole magnets having its magnetic North-South axis substantially parallel to the supporting surface/substrate surface having its magnetic North-South axis substantially radial with respect to the axis of rotation, and the North-South directions of said one or more bar dipole magnets pointing either all towards or all away from the axis of rotation; or
   g) three or more bar dipole magnets below the supporting surface, all three or more magnets being located in a static manner about a center of symmetry, each of the three or more bar dipole magnets having i) its magnetic North-South axis substantially parallel to the supporting surface, ii) its magnetic North-South axis aligned such as to be substantially radially extending from the center of symmetry and iii) the North-South directions of said one or more magnets pointing either all towards or all away from the center of symmetry.

11. The magnetic-field-generating device for forming an optical effect layer according to item 10, embodiments b2, c), or d) wherein, upon rotation of the magnets around the axis of rotation, time dependently magnetic field lines that are substantially parallel to the supporting surface are generated in an area defining a loop-shape and within a central area surrounded by the loop-shape and being spaced apart from the loop-shape.

12. The magnetic-field-generating device according to item 12, wherein the loop-shaped body takes the form of a ring and the central area surrounded by the loop-shaped body takes the form of a solid circle or half-sphere.

13. A printing assembly comprising the magnetic-field-generating devices recited in any one of items 8-12.

14. Use of the magnetic-field-generating devices recited in item 8-12 for producing the OEL recited in any one of items 1-7.

15. A process for producing an optical effect layer (OEL) comprising the steps of:
   a) applying on a substrate surface or on a supporting surface of magnetic-field-generating device a coating composition comprising a binder and a plurality of non-spherical magnetic or magnetizable particles, said coating composition being in a first state, b) exposing the coating composition in a first state to the magnetic field of a magnetic-field-generating device, preferably one as defined in any of items 8-12, thereby orienting at least a part of the non-spherical magnetic or magnetizable particles in at least a loop-shaped area surrounding one central area such that, in a cross-section perpendicular to the OEL and extending from the centre of the central area, the longest axis of the particles present in the loop-shaped area follow a tangent of either a negatively curved or a positively curved part of a hypothetical circle, and c) hardening the coating composition to a second state so as to fix the magnetic or magnetizable non-spherical particles in their adopted positions and orientations.

16. The process according to item 15, wherein the hardening step c) is done by UV-Vis light radiation curing.

17. An optical effect layer according to any one of items 1-7, which is obtainable by the process of item 15 or item 16.

18. An optical effect coated substrate (OEC) comprising one or more optical effect layers according to any one of items 1-7 or 17 on a substrate.

19. A security document, preferably a banknote or an identity document, comprising an optical effect layer recited in any one of items 1-7 or 17.

20. Use of the optical effect layer recited in any one of items 1-7 or 18 or of the optical effect coated substrate recited in item 18 for the protection of a security document against counterfeiting or fraud or for a decorative application.

BRIEF DESCRIPTION OF DRAWINGS

The optical effect layer (OEL) according to the present invention and its production are now described in more detail with reference to the drawings and to particular embodiments, wherein FIG. 1 schematically illustrates a toroidal body (FIG. 1A) and the variation of orientation of non-spherical magnetic or magnetizable particles following a tangent to either a negative curve (FIG. 1B) or a positive curve (FIG. 1C) of a hypothetical ellipse in a cross section extending from the center of a central area surrounded by a loop-shaped area forming the optical effect of a loop-shaped body, with respect to the substrate surface (not shown, below the layer L in the figure) on which the OEL (L) is provided. FIGS. 1B and 1C thus illustrate the orientation of the particles, in a cross section perpendicular to the plane of the OEL and extending from the center of the central area of a part of loop-shaped area providing the optical effect of a loop-shaped body from inside (the side of the central area) to outside.

FIG. 2 FIG. 2A shows a photograph of an OEL providing a dynamic optical effect of a loop-shaped body as provided according to one embodiment of the present invention.

FIG. 6 schematically illustrate the structure of magnetic-field-generating devices for producing an OEL according to a fifth exemplary embodiment.

DETAILED DESCRIPTION

Definitions

Figure 1A:
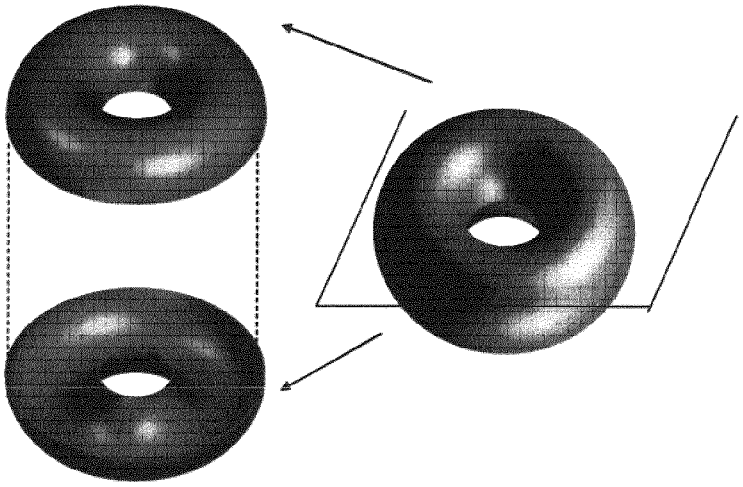
In FIGS. 1B and 1C, the orientation of the longest axis of the particles follow a tangent of either a negatively curved or a positively curved part of a hypothetical ellipse in the cross-section.

The following definitions are to be used to interpret the meaning of the terms discussed in the description and recited in the claims.

As used herein, the indefinite article "a" indicates one as well as more than one and does not necessarily limit its referent noun to the singular.

As used herein, the term "about" means that the amount or value in question may be the specific value designated or some other value in its neighborhood. Generally, the term "about" denoting a certain value is intended to denote a range within ±5% of the value. As one example, the phrase "about 100" denotes a range of 100±5, i.e. the range from 95 to 105. Generally, when the term "about" is used, it can be expected that similar results or effects according to the invention can be obtained within a range of ±5% of the indicated value.

As used herein, the term "and/or" means that either all or only one of the elements of said group may be present. For example, "A and/or B" shall mean "only A, or only B, or both A and B". In the case of "only A", the term also covers the possibility that B is absent, i.e. "only A, but not B".

The term "substantially parallel" refers to deviating less than 20° from parallel alignment and the term "substantially perpendicular" refers to deviating less than 20° from perpendicular alignment. Preferably, the term "substantially parallel" refers to not deviating more than 10° from parallel alignment and the term "substantially perpendicular" refers to not deviating more than 10° from perpendicular alignment.

The term "at least partially" is intended to denote that the following property is fulfilled to a certain extent or completely. Preferably, the term denotes that the following property is fulfilled to at least 50% or more, more preferably at least 75%, even more preferably at least 90%. It may be preferable that the term denotes "completely".

The terms "substantially" and "essentially" are used to denote that the following feature, property or parameter is either completely (entirely) realized or satisfied or to a major degree that does adversely affect the intended result. Thus, depending on the circumstances, the term "substantially" or "essentially" preferably means e.g. at least 80%, at least 90%, at least 95%, or 100%.

The term "comprising" as used herein is intended to be non-exclusive and open-ended. Thus, for instance a coating composition comprising a compound A may include other compounds besides A. However, the term "comprising" also covers the more restrictive meanings of "consisting essentially of" and "consisting of", so that for instance "a coating composition comprising a compound A" may also (essentially) consist of the compound A.

The term "coating composition" refers to any composition which is capable of forming an optical effect layer (OEL) of the present invention on a solid substrate and which can be applied preferentially but not exclusively by a printing method. The coating composition comprises at least a plurality of non-spherical magnetic or magnetizable particles and a binder. Due to their non-spherical shape, the particles have non-isotropic reflectivity.

The term "optical effect layer (OEL)" as used herein denotes a layer that comprises at least a plurality of oriented non-spherical magnetic or magnetizable particles and a binder, wherein the orientation of the non-spherical magnetic or magnetizable particles is fixed within the binder.

As used herein, the term "optical effect coated substrate (OEC)" is used to denote the product resulting from the provision of the OEL on a substrate. The OEC may consist of the substrate and the OEL, but may also comprise other materials and/or layers other than the OEL. The term OEC thus also covers security documents, such as banknotes.

The term "loop-shaped area" denotes an area within the OEL that re-combines with itself and provides the optical effect or optical impression of a loop-shaped body. The area takes the form of a closed loop surrounding one central area. The "loop-shape" can have a round, oval, ellipsoid, square, triangular, rectangular or any polygonal shape. Examples of loop-shapes include a circle, a rectangle or square (preferably with rounded corners), a triangle, a pentagon, a hexagon, a heptagon, an octagon etc. Preferably, the area forming a loop does not cross itself. The term "loop-shaped body" is used to denote the optical effect that is obtained by orienting non-spherical magnetic or magnetizable particles in the loop-shaped area such that the impression of a three-dimensional body is provided to a viewer.

The term "security element" is used to denote an image or graphic element that can be used for authentication purposes. The security element can be an overt and/or a covert security element.

The term 'magnetic axis' or "North-South axis" denotes a theoretical line connecting and extending through the North and South pole of a magnet. The line does not have a certain direction. Conversely, the term "North-South direction" denotes the direction along the North-South axis or magnetic axis from the North pole to the South pole.

DETAILED DESCRIPTION OF THE INVENTION

In one aspect, the present invention relates to an OEL that is typically provided on a substrate, forming an OEC. The OEL comprises a plurality of non-spherical magnetic or magnetizable particles that, due to their non-spherical shape, have a non-isotropic reflectivity. The particles are dispersed in a binder material and have a specific orientation for providing the optical effect. The orientation is achieved by orienting the particles in accordance with an external magnetic field, as will be explained in more detail in the following.

In the OEL, the non-spherical magnetic or magnetizable particles are dispersed in a coating composition comprising a hardened binder material that fixes the orientation of the non-spherical magnetic or magnetizable particles. The hardened binder material is at least partially transparent to electromagnetic radiation of one or more wavelengths in the range of 200 nm to 2500 nm. Preferably, the hardened binder material is at least partially transparent to electromagnetic radiation of one or more wavelengths in the range of 200-800 nm, more preferably in the range of 400-700 nm. Herein, the term "one or more wavelengths" denotes that the binder material may be transparent to only one wavelength in a given wavelength range, or may be transparent to several wavelengths in a given range. Preferably, the binder material is transparent to more than one wavelength in the given range, and more preferably to all wavelengths in the given range. Thus, in a more preferred embodiment, the hardened binder material is at least partly transparent to all wavelengths in the range of about 200-about 2500 nm (or 200-800 nm, or 400-700 nm), and even more preferably the hardened binder material is fully transparent to all wavelengths in these ranges.

Herein, the term "transparent" denotes that the transmission of electromagnetic radiation through a layer of 20 μm of the hardened binder material as present in the OEL (not including the non-spherical magnetic or magnetizable particles, but all other optional components of the OEL in case such components are present) is at least 80%, more preferably at least 90%, even more preferably at least 95%. This can be determined for example by measuring the transmittance of a test piece of the hardened binder material (not including the non-spherical magnetic or magnetizable particles) in accordance with well-established test methods, e.g. DIN 5036-3 (1979-11).

The non-spherical magnetic or magnetizable particles described herein have, due to their non-spherical shape, non-isotropic reflectivity with respect to an incident electromagnetic radiation for which the hardened binder material is at least partially transparent. As used herein, the term "non-isotropic reflectivity" denotes that the proportion of incident radiation from a first angle that is reflected by a particle into a certain (viewing) direction (a second angle) is a function of the orientation of the particles, i.e. that a change of the orientation of the particle with respect to the first angle can lead to a different magnitude of the reflection to the viewing direction.

Preferably, each of the plurality of non-spherical magnetic or magnetizable particles described herein have a non-isotropic reflectivity with respect to incident electromagnetic radiation in some parts or in the complete wavelength range between about 200 and about 2500 nm, more preferably between about 400 and about 700 nm, such that a change of the particle's orientation results in a change of reflection by that particle into a certain direction.

In the OEL of the present invention, the non-spherical magnetic or magnetizable particles are provided in such a manner as to form a dynamic loop-shaped security element.

Herein, the term "dynamic" denotes that the appearance and the light reflection of the security element changes depending on the viewing angle. Put differently, the appearance of the security element is different when viewed from different angles, i.e. the security element exhibits a different appearance (e.g. when viewed from a viewing angle of about 22.5° as compared to a viewing angle of about 90°, both with respect to the plane of the OEL). This behaviour is caused by the orientation of the non-spherical magnetic or magnetizable particles having non-isotropic reflectivity and/or the properties of the non-spherical magnetic or magnetizable particles as such having a viewing angle dependent appearance (such as optically variable pigments described later).

Figure 13:
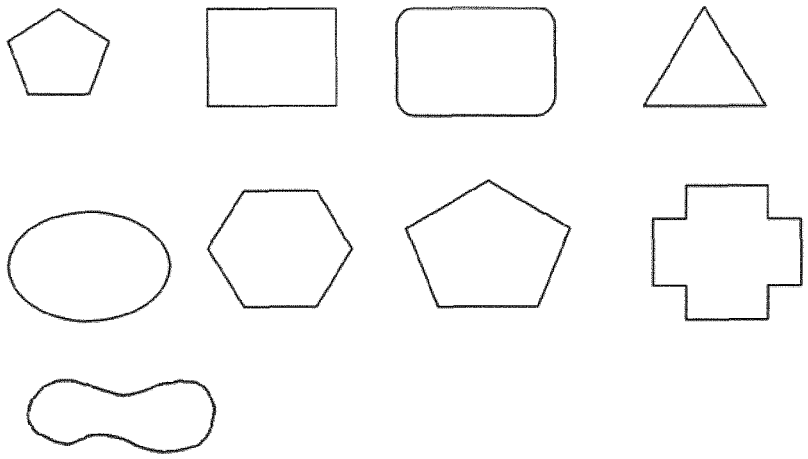
FIG. 13 shows examples of loop-shapes surrounding one central area.

The term "loop-shaped body" denotes that the non-spherical magnetic or magnetizable particles are provided such that the OEL confers to the viewer the visual impression of a closed body re-combining with itself, forming a closed loop-shaped body surrounding one central area. The "loop-shaped body" can have round, oval, ellipsoid, square, triangular, rectangular or any polygonal shape. Examples of loop-shapes include a circle, a rectangle or square (preferably with rounded corners), a triangle, a (regular or irregular) pentagon, a (regular or irregular) hexagon, a (regular or irregular) heptagon, an (regular or irregular) octagon, any polygonal shape, etc. Preferably, the loop-shaped body does not cross itself (as for instance in a double loop or in a shape wherein multiple rings overlap with each other, such as in the Olympic rings). Examples of loop-shapes are also shown in FIG. 13.

In the present invention, the optical impression of a loop-shaped body is formed by the orientation of the non-spherical magnetic or magnetizable particles. That is, the loop-shape of the loop-shaped body is not achieved by applying, such as for example by printing, the coating composition comprising the binder material and the non-spherical magnetic or magnetizable particles in loop-shape on a substrate, but by aligning the non-spherical magnetic or magnetizable particles according to a magnetic field in a loop-shaped area of the OEL. The loop-shaped area thus represents a portion of the overall area of the OEL, which—besides the loop-shaped area—also contains a portion wherein the non-spherical magnetic or magnetizable particles are either not aligned at all (i.e. have a random orientation) or are aligned such that they do not contribute to the impression of a loop-shaped body. In this portion not contributing to the impression of a loop-shaped body, typically at least a part of the particles are oriented so that their longest axis is substantially perpendicular to the plane of the OEL.

Preferably, the non-spherical magnetic or magnetizable particles are prolate or oblate ellipsoid-shaped, platelet-shaped or needle-shaped particles or mixtures thereof. Thus, even if the intrinsic reflectivity per unit surface area (e.g. per $\mu m^2$) is uniform across the whole surface of such particle, due to its non-spherical shape, the reflectivity of the particle is non-isotropic as the visible area of the particle depends on the direction from which it is viewed. In one embodiment, the non-spherical magnetic or magnetizable particles having non-isotropic reflectivity due to their non-spherical shape may further have an intrinsic non-isotropic reflectivity, such as for instance in optically variable magnetic pigments, due to the presence of layers of different reflectivity and refractive indexes. In this embodiment, the non-spherical magnetic or magnetizable particles comprise non-spherical magnetic or magnetizable particles having intrinsic non-isotropic reflectivity, such as non-spherical optically variable magnetic or magnetizable pigments.

Suitable examples of non-spherical magnetic or magnetizable particles described herein include without limitation particles comprising a ferromagnetic or a ferrimagnetic metal such as cobalt, iron, or nickel; a ferromagnetic or ferrimagnetic alloy of iron, manganese, cobalt, iron or nickel; a ferromagnetic or ferrimagnetic oxide of chromium, manganese, cobalt, iron, nickel or mixtures thereof; as well as the mixtures thereof. Ferromagnetic or ferrimagnetic oxides of chromium, manganese, cobalt, iron, nickel or mixtures thereof may be pure or mixed oxides. Examples of magnetic oxides include without limitation iron oxides such as hematite ($Fe_2O_3$), magnetite ($Fe_3O_4$), chromium dioxide ($CrO_2$), magnetic ferrites ($MFe_2O_4$), magnetic spinels ($MR_2O_4$), magnetic hexaferrites ($MFe_{12}O_{19}$), magnetic orthoferrites ($RFeO_3$), magnetic garnets $M_3R_2(AO_4)_3$, wherein M stands for a two-valent and R for a three-valent, and A for a four-valent metal ion, and "magnetic" for ferro- or ferrimagnetic properties.

Optically variable elements are known in the field of security printing. Optically variable elements (also referred in the art as colorshifting or goniochromatic elements) exhibit a viewing-angle or incidence-angle dependent color, and are used to protect banknotes and other security documents against counterfeiting and/or illegal reproduction by commonly available color scanning, printing and copying office equipment.

Preferably, at least a part of the plurality of non-spherical magnetic or magnetizable particles described herein is constituted by non-spherical optically variable magnetic or magnetizable pigments. Such non-spherical optically variable magnetic or magnetizable pigments are preferably prolate or oblate ellipsoid-shaped, platelet-shaped or needle-shaped particles, or mixtures thereof.

The plurality of non-spherical magnetic or magnetizable particles may comprise non-spherical optically variable magnetic or magnetizable pigments and/or non-spherical magnetic or magnetizable particles having no optically variable properties.

Figure 2A:
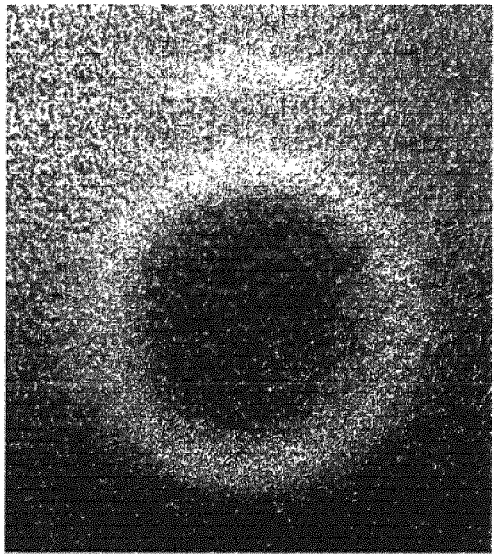
Figure 2B:
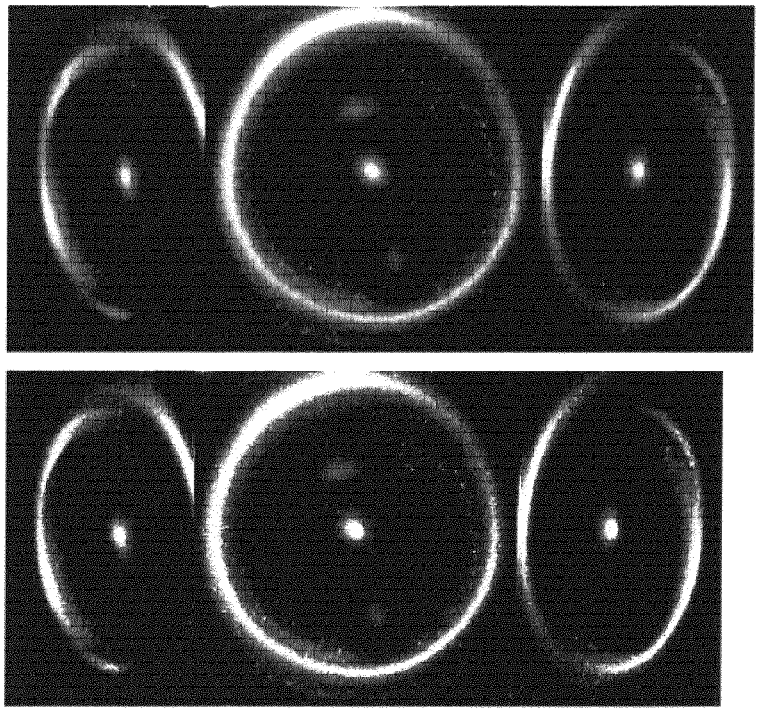
FIG. 2B shows a photograph of an OEL with a protrusion according to one embodiment of the present invention.

As will be explained later, the optical impression of a loop-shaped body is formed by orienting (aligning) the plurality of non-spherical magnetic or magnetizable particles according to the field lines of a magnetic field, leading to the appearance of a highly dynamic viewing-angle dependent impression of a loop-shaped body. If at least a part of the plurality of non-spherical magnetic or magnetizable particles described herein is constituted by non-spherical optically variable magnetic or magnetizable pigments, an additional effect is obtained, since the color of non-spherical optically variable magnetic or magnetizable pigments noteworthy depends on the viewing-angle or incidence-angle with respect to the plane of the pigment, thus resulting in a combined effect with the viewing-angle dependent dynamic loop-shaped effect. As shown in FIGS. 2A and 2B, the use of magnetically oriented non-spherical optically variable pigments in the area of the OEL forming the impression of a dynamic loop-shaped body according to the present invention enhances the visual contrast of the bright zones and improves the visual impact of the loop-shaped body in document security and decorative applications. The combination of the dynamic loop-shape with the colour change observed for optically variable pigments, obtained by using a magnetically oriented non-spherical colour-shifting optically variable pigment, results in a margin of different colour in the loop-shaped body, which is easily verified by the unaided eye. Thus, in a preferred embodiment of the present invention, the optical impression of a loop-shaped body is formed at least in part by magnetically oriented non-spherical optically variable pigments.

In addition to the overt security provided by the colorshifting property of the non-spherical optically variable magnetic or magnetizable pigments, which allows easily detecting, recognizing and/or discriminating the OEC (such as a security document) carrying the OEL according to the present invention from their possible counterfeits with the unaided human senses, e.g. because such features may be visible and/or detectable while still being difficult to produce and/or to copy, the colorshifting property of the non-spherical optically variable magnetic or magnetizable pigments may be used as a machine readable tool for the recognition of the OEL. Thus, the optically variable properties of the non-spherical optically variable magnetic or magnetizable pigments may simultaneously be used as a covert or semi-covert security feature in an authentication process wherein the optical (e.g. spectral) properties of the particles are analyzed.

The use of non-spherical optically variable magnetic or magnetizable pigments enhances the significance of the OEL as a security feature in security document applications, because such materials (i.e. optically variable magnetic or magnetizable pigments) are reserved to the security document printing industry and are not commercially available to the public.

As mentioned above, preferably at least a part of the plurality of non-spherical magnetic or magnetizable particles is constituted by non-spherical optically variable magnetic or magnetizable pigments. These can more preferably be selected from the group consisting of magnetic thin-film interference pigments, magnetic cholesteric liquid crystal pigments and mixtures thereof.

Magnetic thin film interference pigments are known to those skilled in the art and are disclosed e.g. in U.S. Pat. No. 4,838,648; WO 2002/073250 A2; EP-A 686 675; WO 2003/000801 A2; U.S. Pat. No. 6,838,166; WO 2007/131833 A1 and in the thereto related documents. Due to their magnetic characteristics, they are machine readable, and therefore coating compositions comprising magnetic thin film interference pigments may be detected for example with specific magnetic detectors. Therefore, coating compositions comprising magnetic thin film interference pigments may be used as a covert or semi-covert security element (authentication tool) for security documents.

Preferably, the magnetic thin film interference pigments comprise pigments having a five-layer Fabry-Perot multilayer structure and/or pigments having a six-layer Fabry-Perot multilayer structure and/or pigments having a seven-layer Fabry-Perot multilayer structure. Preferred five-layer Fabry-Perot multilayer structures consist of absorber/dielectric/reflector/dielectric/absorber multilayer structures wherein the reflector and/or the absorber is also a magnetic layer. Preferred six-layer Fabry-Perot multilayer structures consist of absorber/dielectric/reflector/magnetic/dielectric/absorber multilayer structures. Preferred seven-layer Fabry Perot multilayer structures consist of absorber/dielectric/reflector/magnetic/reflectorldielectric/absortber multilayer structures such as disclosed in U.S. Pat. No. 4,838,648; and more preferably seven-layer Fabry-Perot absorber/dielectric/reflector/magnetic/reflector/dielectric/absorber multilayer structures. Preferably, the reflector layers described herein are selected from the group consisting of metals, metal alloys and combinations thereof, preferably selected from the group consisting of reflective metals, reflective metal alloys and combinations thereof, and more preferably from the group consisting of aluminum (Al), chromium (Cr), nickel (Ni), and mixtures thereof and still more preferably aluminum (Al). Preferably, the dielectric layers are independently selected from the group consisting of magnesium fluoride ($MgF_2$), silicium dioxide ($SiO_2$) and mixtures thereof, and more preferably magnesium fluoride ($MgF_2$). Preferably, the absorber layers are independently selected from the group consisting of chromium (Cr), nickel (Ni), metallic alloys and mixtures thereof. Preferably, the magnetic layer is preferably selected from the group consisting of nickel (Ni), iron (Fe) and cobalt (Co), alloys comprising nickel (Ni), iron (Fe) and/or cobalt (Co), and mixtures thereof. It is particularly preferred that the magnetic thin film interference pigments comprise a seven-layer Fabry-Perot absorber/dielectrireflector/magnetic/reflector/dielectric/absorber multilayer structure consisting of a $Cr/MgF_2/Al/N/Al/MgF_2/Cr$ multilayer structure.

Magnetic thin film interference pigments described herein are typically manufactured by vacuum deposition of the different required layers onto a web. After deposition of the desired number of layers, e.g. by PVD, the stack of layers is removed from the web, either by dissolving a release layer in a suitable solvent, or by stripping the material from the web. The so-obtained material is then broken down to flakes which have to be further processed by grinding, milling or any suitable method. The resulting product consists of flat flakes with broken edges, irregular shapes and different aspect ratios. Further information on the preparation of suitable magnetic thin film interference pigments can be found e.g. in EP-A 1 710 756, which is hereby incorporated by reference.

Suitable magnetic cholesteric liquid crystal pigments exhibiting optically variable characteristics include without limitation monolayered cholesteric liquid crystal pigments and multilayered cholesteric liquid crystal pigments Such pigments are disclosed for example in WO 2006/063926 A1, U.S. Pat. No. 6,582,781 and U.S. Pat. No. 6,531,221. WO 2006/063926 A1 discloses monolayers and pigments obtained therefrom with high brilliance and colorshifting properties with additional particular properties such as magnetizability. The disclosed monolayers and pigments, which are obtained therefrom by comminuting said monolayers, comprise a three-dimensionally crosslinked cholesteric liquid crystal mixture and magnetic nanoparticles. U.S. Pat. No. 6,582,781 and U.S. Pat. No. 6,410,130 disclose platelet-shaped cholesteric multilayer pigments which comprise the sequence $A^1/B/A^2$, wherein $A^1$ and $A^2$ may be identical or different and each comprises at least one cholesteric layer, and B is an interlayer absorbing all or some of the light transmitted by the layers $A^1$ and $A^2$ and imparting magnetic properties to said interlayer. U.S. Pat. No. 6,531,221 discloses platelet-shaped cholesteric multilayer pigments which comprise the sequence A/B and if desired C, wherein A and C are absorbing layers comprising pigments imparting magnetic properties, and B is a cholesteric layer.

In addition to the non-spherical magnetic or magnetizable particles (which may or may not comprise or consist of non-spherical optically variable magnetic or magnetizable pigments), also non-magnetic or non-magnetizable particles may be contained in the loop-shaped security element and/or the OEL outside and/or inside the loop-shaped security element. These particles may be colour pigments known in the art, having or not having optically variable properties. Further, the particles may be spherical or non-spherical and may have isotropic or non-isotropic optical reflectivity.

In the OEL, the non-spherical magnetic or magnetizable particles described herein are dispersed in a binder material. Preferably, the non-spherical magnetic or magnetizable particles are present in an amount from about 5 to about 40 weight percent, more preferably about 10 to about 30 weight percent, the weight percentages being based on the total dry weight of the OEL, comprising the binder material, the non-spherical magnetic or magnetizable particles and other optional components of the OEL.

As described previously, the hardened binder material is at least partially transparent to electromagnetic radiation of one or more wavelengths in the range of 200-2500 nm, more preferably in the range of 200-800 nm, even more preferably in the range of 400-700 nm. The binder material is thus, at least in its hardened or solid state (also referred to as second state below), at least partially transparent to electromagnetic radiation of one or more wavelengths in the range of about 200 nm to about 2500 nm, i.e. within the wavelength range which is typically referred to as the "optical spectrum" and which comprises infrared, visible and UV portions of the electromagnetic spectrum such that the particles contained in the binder material in its hardened or solid state and their orientation-dependent reflectivity can be perceived through the binder material.

More preferably, the binder material is at least partially transparent in the range of visible spectrum between about 400 nm to about 700 nm. Incident electromagnetic radiation, e.g. visible light, entering the OEL through its surface can reach the particles dispersed within the OEL and be reflected there, and the reflected light can leave the OEL again for producing the desired optical effect. If the wavelength of incident radiation is selected outside the visible range, e.g. in the near UV-range, then the OEL may also serve as a covert security feature, as then typically technical means will be necessary to detect the (complete) optical effect generated by the OEL under respective illuminating conditions comprising the selected non-visible wavelength. In this case, it is preferable that the OEL and/or the loop-shaped area contained therein comprises luminescent pigments that show luminescence in response to the selected wavelength outside the visible spectrum contained in the incident radiation. The infrared, visible and UV portions of the electromagnetic spectrum approximately correspond to the wavelength ranges between 700-2500 nm, 400-700 nm, and 200-400 nm respectively.

If the OEL is to be provided on a substrate, it is necessary that the coating composition comprising at least the binder material and the non-spherical magnetic or magnetizable particles is in form that allows processing of the coating composition, e.g. by printing, in particular copperplate intaglio printing, screen printing, gravure printing, flexography printing or roller coating, to thereby apply the coating composition to the substrate, such as a paper substrate or those described hereafter. Further, after application of the coating composition on a substrate, the non-spherical magnetic or magnetizable particles are oriented by applying a magnetic field, aligning the particles along the field lines. Herein, the non-spherical magnetic or magnetizable particles are oriented in a loop-shaped area of the coating composition on the substrate such that, to a viewer regarding the substrate from a direction normal to the plane of the substrate, the optical impression of a loop-shaped body is formed. Subsequently or simultaneously with the step of orienting/aligning the particles by applying a magnetic field, the orientation of the particles is fixed. The coating composition must thus noteworthy have a first state, i.e. a liquid or pasty state, wherein the coating composition is wet or soft enough, so that the non-spherical magnetic or magnetizable particles dispersed in the coating composition are freely movable, rotatable and/or orientable upon exposure to a magnetic field, and a second hardened (e.g. solid) state, wherein the non-spherical particles are fixed or frozen in their respective positions and orientations.

Such a first and second state is preferably provided by using a certain type of coating composition. For example, the components of the coating composition other than the non-spherical magnetic or magnetizable particles may take the form of an ink or coating composition such as those which are used in security applications, e.g. for banknote printing.

The aforementioned first and second state can be provided by using a material that shows a great increase in viscosity in reaction to a stimulus such as for example a temperature change or an exposure to an electromagnetic radiation. That is, when the fluid binder material is hardened or solidified, said binder material converts into the second state, i.e. a hardened or solid state, where the particles are fixed in their current positions and orientations and can no longer move nor rotate within the binder material.

As known to those skilled in the art, ingredients comprised in an ink or coating composition to be applied onto a surface such as a substrate and the physical properties of said ink or coating composition are determined by the nature of the process used to transfer the ink or coating composition to the surface. Consequently, the binder material comprised in the ink or coating composition described herein is typically chosen among those known in the art and depends on the coating or printing process used to apply the ink or coating composition and the chosen hardening process.

In one embodiment, a polymeric thermoplastic binder material or a thermoset may be employed. Unlike thermosets, thermoplastic resins can be repeatedly melted and solidified by heating and cooling without incurring any important changes in properties. Typical examples of thermoplastic resin or polymer include without limitation polyamides, polyesters, polyacetals, polyolefins, styrenic polymers, polycarbonates, polyarylates, polyimides, polyether ether ketones (PEEK), polyetherketeoneketones (PEKK), polyphenylene based resins (e.g. polyphenylenethers, polyphenylene oxides, polyphenylene sulfides), polysulphones and mixtures of these.

After application of the coating composition on a substrate and orientation of the non-spherical magnetic or magnetizable particles, the coating composition is hardened (i.e. turned to a solid or solid-like state) in order to fix the orientation of the particles.

The hardening can be of purely physical nature, e.g. in cases where the coating composition comprises a polymeric binder material and a solvent and is applied at high temperatures. Then, the particles are oriented at high temperature by the application of a magnetic field, and the solvent is evaporated, followed by cooling of the coating composition. Thereby the coating composition is hardened and the orientation of the particles is fixed.

Alternatively and preferably, the "hardening" of the coating composition involves a chemical reaction, for instance by curing, which is not reversed by a simple temperature increase (e.g. up to 80° C.) that may occur during a typical use of a security document. The term "curing" or "curable" refers to processes including the chemical reaction, crosslinking or polymerization of at least one component in the applied coating composition in such a manner that it turns into a polymeric material having a greater molecular weight than the starting substances. Preferably, the curing causes the formation of a three-dimensional polymeric network.

Such a curing is generally induced by applying an external stimulus to the coating composition (i) after its application on a substrate surface or a supporting surface of a magnetic field generation device and (ii) subsequently or simultaneously with the orientation of the magnetic or magnetizable particles. Therefore, preferably the coating composition is an ink or coating composition selected from the group consisting of radiation curable compositions, thermal drying compositions, oxidatively drying compositions, and combinations thereof. Particularly preferably, the coating composition is an ink or coating composition selected from the group consisting of radiation curable compositions.

Preferable radiation curable compositions include compositions that may be cured by UV-visible light radiation (hereafter referred as UV-Vis-curable) or by E-beam radiation (hereafter referred as EB). Radiation curable compositions are known in the art and can be found in standard textbooks such as the series "Chemistry & Technology of UV & EB Formulation for Coatings, Inks & Paints", published in 7 volumes in 1997-1998 by John Wiley & Sons in association with SITA Technology Limited.

According to one particularly preferred embodiment of the present invention, the ink or coating composition described herein is a UV-Vs-curable composition. UV-Vis curing advantageously allows very fast curing processes and hence drastically decreases the preparation time of the OEL according to the present invention and articles and documents comprising said OEL. Preferably, the UV-Vis-curable composition comprises one or more compounds selected from the group consisting of radically curable compounds, cationically curable compounds and mixtures thereof. Cationically curable compounds are cured by cationic mechanisms typically including the activation by radiation of one or more photoinitiators which liberate cationic species, such as acids, which in turn initiate the curing so as to react and/or cross-link the monomers and/or oligomers to thereby harden the coating composition. Radically curable compounds are cured by free radical mechanisms typically including the activation by radiation of one or more photoinitiators, thereby generating radicals which in turn initiate the polymerization so as to harden the coating composition.

The coating composition may further comprise one or more machine readable materials selected from the group consisting of magnetic materials, luminescent materials, electrically conductive materials, infrared-absorbing materials and mixtures thereof. As used herein, the term "machine readable material" refers to a material which exhibits at least one distinctive property which is not perceptible by the naked eye, and which can be comprised in a layer so as to confer a way to authenticate said layer or article comprising said layer by the use of a particular equipment for its authentication.

The coating composition may further comprise one or more coloring components selected from the group consisting of organic and inorganic pigments and organic dyes, and/or one or more additives. The latter include without limitation compounds and materials that are used for adjusting physical, rheological and chemical parameters of the coating composition such as the viscosity (e.g. solvents, thickeners and surfactants), the consistency (e.g. anti-settling agents, fillers and plasticizers), the foaming properties (e.g. antifoaming agents), the lubricating properties (waxes, oils), UV stability (photosensitizers and photostabilizers), the adhesion properties, the antistatic properties, the storage stability (polymerization inhibitors) etc. Additives described herein may be present in the coating composition in amounts and in forms known in the art, including in the form of so-called nano-materials where at least one of the dimensions of the additive is in the range of 1 to 1000 nm.

Following or simultaneously with the application of the coating composition on a substrate surface or a supporting surface of magnetic-field-generating device, the non-spherical magnetic or magnetizable particles are oriented by the use of an external magnetic field for orienting them according to a desired orientation pattern. Thereby, a permanent magnetic particle is oriented such that its magnetic axis is aligned with the direction of the external magnetic field line at the particle's location. A magnetizable particle without an intrinsic permanent magnetic field is oriented by the external magnetic field such that the direction of its longest dimension is aligned with a magnetic field line at the particle's location. The above applies analogously in the event that the particles should have a layer structure including a layer having magnetic or magnetizable properties. In this case, the longest axis of the magnetic layer or the longest axis of the magnetizable layer is aligned with the direction of the magnetic field.

Upon applying a magnetic field, the non-spherical magnetic or magnetizable particles adopt an orientation in the layer of the coating composition such that the visual appearance or optical impression of a dynamic loop-shaped body is produced that is visible from at least one surface of the OEL (see e.g. FIGS. 1 and 2). Consequently, the dynamic loop-shaped body can be seen by an observer as a reflection zone that exhibits a dynamic visual motion effect upon rotation or tilting of the OEL, said loop-shaped body appearing to move in a different plane than the rest of the OEL. Subsequently or simultaneously with the orientation of the non-spherical magnetic or magnetizable particles, the coating composition is hardened to fix the orientation, e.g. by irradiation with UV-Vis light in the case of a UV-Vis-curable coating composition.

Under a given direction of incident light, e.g. vertical, the zone of highest reflectivity, i.e. of specular reflection at non-spherical magnetic or magnetizable particles, of an OEL (L) comprising the particles with fixed orientation changes location as a function of the viewing (tilt) angle: looking at the OEL (L) from the left side, a loop-shaped bright zone is seen at location 1, looking at the OEL from the top, a loop-shaped bright zone is seen at location 2, and looking at the layer from the right side, a loop-shaped bright zone is seen at location 3. Upon changing the viewing direction from left to right, the loop-shaped bright zone appears thus to move as well from left to right. It is also possible to obtain the opposite effect, that upon changing the viewing direction from left to right, the loop-shaped bright zone appears to move from right to left. Depending on the sign of the curvature of the non-spherical magnetic or magnetizable particles present in the loop-shaped body, which may be negative (see FIG. 1B) or positive (see FIG. 1C), the dynamic loop-shaped element is observable as moving towards the observer (in the case of a positive curve, FIG. 1C) or moving away from the observer (negative curve, FIG. 1B) in relation to a movement performed by the observer relative to the OEL. Notably, the position of the observer is above the OEL in FIG. 1. Such a dynamic optical effect or optical impression is observed if the OEL is tilted, and, due to the loop-shape, the effect can be observed regardless of the tilting direction of e.g. a banknote on which the OEL is provided. For instance, the effect can be observed when a banknote carrying the OEL is tilted from left to right and also up and down.

The area of the OEL forming the optical impression of a loop-shaped body (i.e. the loop-shaped area of the OEL) comprises the oriented non-spherical magnetic or magnetizable particles and thereby forms the optical effect of at least a loop-shaped body surrounding one central area (a closed loop). In this area, the orientation of the longest axis of the non-spherical magnetic or magnetizable particles follow the tangent of either the negatively curved or the positively curved part of a hypothetical ellipse or circle when seen in a cross-section in the direction extending from the center of the central area to the space outside the loop-shaped area, from the boundary of the loop-shaped area with the central area to the boundary of the loop-shaped area with the area outside the loop-shaped area. In this cross-sectional view of the loop-shaped area, the orientation of the particles is substantially parallel to the plane of the OEL in about the center of the loop-shaped area and changes gradually towards a less parallel—typically a substantially perpendicular—orientation towards the boundaries of the loop-shaped area in such a cross-sectional view. This is illustrated in FIG. 1, and further illustrated in FIGS. 14A and 14B. Notably, the rate of change in orientation from a substantially parallel orientation to a more perpendicular orientation may be constant (the orientation of the non-spherical particles follows a tangent of a negatively or positively curved part of a circle) or may vary along the width of the loop-shaped area (the orientation of the non-spherical particles follows a tangent of a negatively or positively curved part of an ellipse).

Figure 14A:
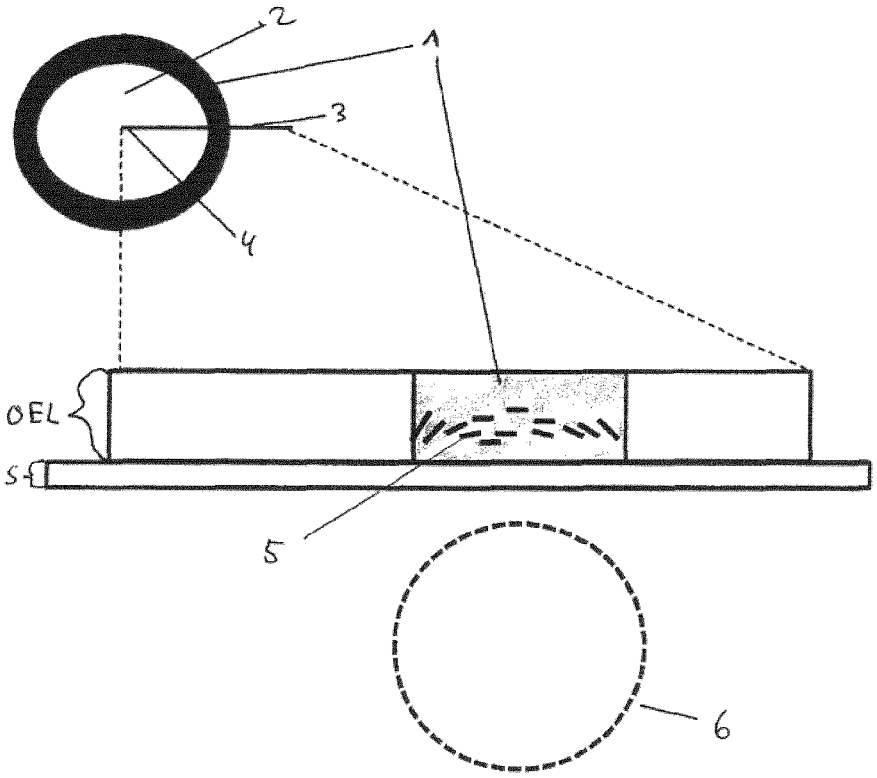
FIG. 14A schematically illustrates the orientation of non-spherical magnetic or magnetizable particles in the loop-shaped security element of the present invention.

In FIG. 14A, an embodiment of an OEL comprising a loop-shaped area provided on a support (S) and the orientation of the non-spherical magnetic or magnetizable particles therein are illustrated. At the top, the optical impression of a loop-shaped body is seen in a plan view of the OEL. At the bottom, a cross-section in the direction extending from the center of the central area to the space outside the loop-shaped area forming the optical impression of a loop-shaped body is shown. In detail, the looped-shaped area forming the optical effect of a loop-shaped body (1) surrounds a central area (2). When seen in a cross-section (3) extending from the center (4) of the central area (2) to the space outside the loop-shaped area, illustrated at the bottom of the figure, the non-spherical magnetic or magnetizable particles (5) are, in the area from the boundary of the loop-shaped area with the central area to the boundary of the loop-shaped area with the area outside the loop-shaped body (indicated by the grey box in which the particles (5) are present), oriented such that their longest axis follow the tangent of the negatively curved part a hypothetical ellipse or circle (a circle (6) in FIG. 14A). Of course, also an orientation that follows a tangent of a positively curved part of the hypothetical ellipse or circle is possible.

In FIG. 14A, only the non-spherical magnetic or magnetizable particles in the area forming the optical impression of a loop-shaped body are shown. However, it will become apparent in the following that such particles may also be present in the central area (2) and outside the loop-shaped area forming the optical impression of a loop-shaped body.

Preferably, in such a cross-sectional view, the center of the hypothetical ellipse or circle (6) is located along a line perpendicular to the OEL (i.e. a vertical line in the bottom part of FIG. 14A) and extending from about the center of the area defining the looped-shaped body, i.e. the area from the boundary of the loop-shaped area with the central area to the boundary of the loop-shaped area with the area outside the loop-shaped body (represented by the grey box in FIG. 14*a* in which the particles (5) are shown, also referred to as "width" of the loop-shaped area). In a further preferred embodiment, additionally or alternatively the diameter of the hypothetical circle or the longest or shortest axis of a hypothetical ellipse is about the same as the width of the looped-shaped area, so that at the boundary of the loop-shaped area with the central area and at the boundary of the loop-shaped area with the area outside the loop-shaped body an orientation of the non-spherical particles substantially perpendicular to the plane of the OEL is realized, which gradually changes to a parallel orientation towards the center of the width of the loop-shaped area (i.e. the middle of the grey box in FIG. 14A). The central area surrounded by the loop-shaped area can be free of the magnetic or magnetizable particles, and in this case the central area may not be part of the OEL. This can be achieved by not providing the coating composition in the central area in the printing step.

Alternatively and preferably, however, the central area is part of the OEL and is not omitted when providing the coating composition to the substrate. This allows for an easier manufacture of the OEL, since the coating composition can be applied to a greater part of the substrate surface. In such a case, there are also non-spherical magnetic or magnetizable particles present in the central area. These can have a random orientation, providing no particular effect but a small reflectance. However, preferably the non-spherical magnetic or magnetizable particles present in the central area are substantially perpendicular to the plane of the optical effect layer (OEL), thereby providing essentially no reflectivity in the direction perpendicular to the plane of the OEL when irradiated from the same side of the OEL.

The orientation of the non-spherical magnetic or magnetizable particles outside the loop-shaped area forming the optical impression of a loop-shaped body can be substantially perpendicular to the plane of the OEL, or can be random. In one embodiment, both the particles in the central area and outside the loop-shaped area (i.e. the particles inside and outside the looped-shaped area) are oriented such as to be substantially perpendicular to the plane of the OEL.

Figure 1B:
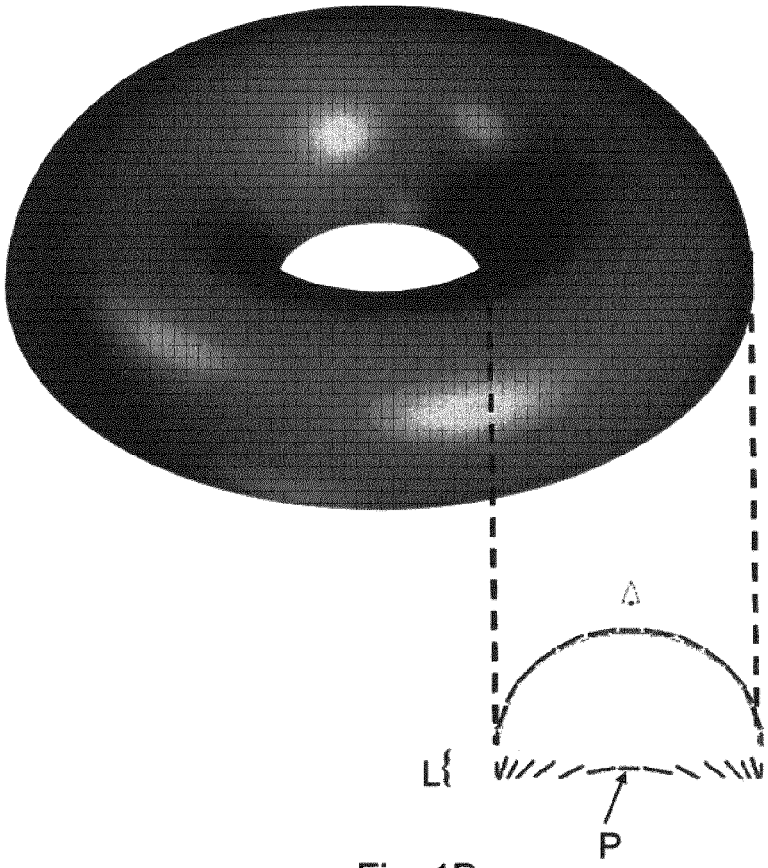

FIG. 1B depicts a cross section of one part of the loop-shaped area in a direction extending from the center of the central area to the outer boundary of the loop-shaped area (i.e. the width of the loop-shaped area). Herein, the non-spherical magnetic or magnetizable particles (P) in an OEL (L) are fixed in the binder material, said particles following the tangent of a negatively curved part of the surface of a hypothetical circle. Figure iC depicts a similar cross section wherein the non-spherical magnetic or magnetizable particles in an OEL follow a tangent of the positively curved part of the surface of a hypothetical ellipse (a circle in the FIGS. 1 and 14).

Figure 14B:
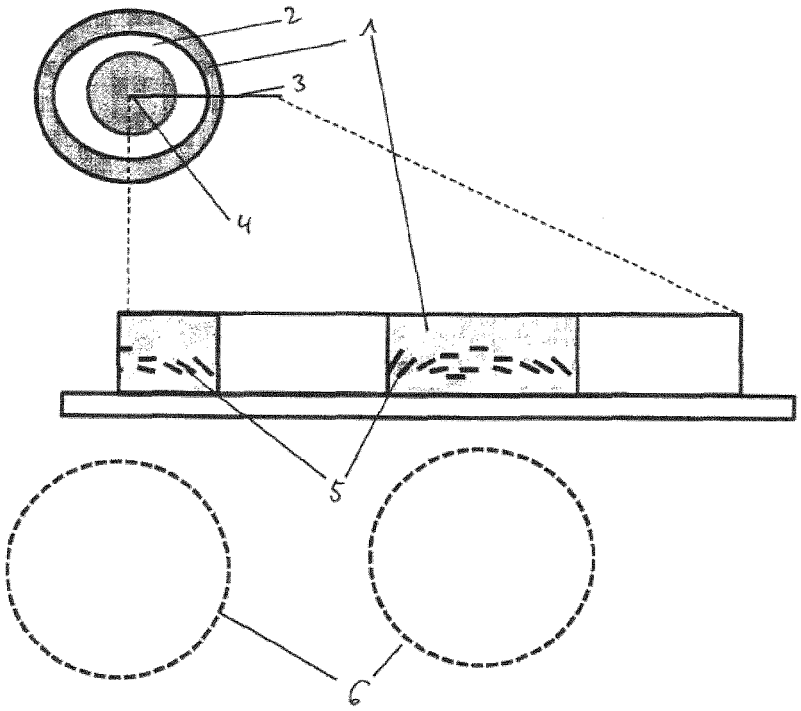
FIG. 14B schematically illustrates the orientation of non-spherical magnetic or magnetizable particles in a loop-shaped security element of the present invention, wherein the central area surrounded by a loop-shape is filled with a protrusion.

In FIGS. 1, 14A, and 14B, the non-spherical magnetic or magnetizable particles (P) are preferably dispersed throughout the whole volume of the OEL, while for the purpose of discussing their orientation within the OEL in respect to the surface of a supporting surface, preferably a substrate, it is assumed that the particles are all located within a same planar cross-section of the OEL. These non-spherical magnetic or magnetizable particles are graphically depicted, each by a short line representing its longest axis. In reality and as shown in FIG. 14A, of course, some of the non-spherical magnetic or magnetizable particles may partially or fully overlap each others when viewed on the OEL.

The total number of non-spherical magnetic or magnetizable particles in the OEL may be appropriately chosen in function of the desired application; however, to make up a surface-covering pattern generating a visible effect, several thousands of particles, such as about 1,000-10,000 particles, are generally required in a volume corresponding to one square millimeter of OEL surface.

The plurality of non-spherical magnetic or magnetizable particles, which together produce the optical effect of the security element of the present invention, may correspond to all or only to a subset of the total number of particles in the OEL. For example, the particles producing the optical effect of a loop-shaped body may be combined with other particles contained in the binder material, which may be conventional or special color pigment particles.

As illustrated in FIG. 2B, according to a particularly preferred embodiment of the present invention, the optical effect layer (OEL) described herein may further provide the optical effect of a so-called "protrusion" caused by a reflection zone in the central area surrounded by the loop-shaped area. This "protrusion" fills the central area partially, and preferably there is the optical impression of a gap between the inner boundary of the loop-shaped body and the outer boundary of the protrusion. The optical impression of such a gap can be achieved by orienting the non-spherical magnetic or magnetizable particles in the area between the inner boundary of the loop-shaped area and the outer boundary of the protrusion substantially perpendicular to the plane of the OEL.

The protrusion provides the impression of a three-dimensional object, such as a half-sphere, present in the central area surrounded by the loop-shape. The three-dimensional object may seemingly extend from the OEL surface to the viewer (in a similar manner as looking on an upright standing or inverted bowl, depending on whether the particles follow a negative or a positive curve), or may seemingly extend from the OEL surface away from the viewer. In these cases, the OEL comprises non-spherical magnetic or magnetizable particles in the central area that are oriented substantially parallel to the plane of the OEL, providing a reflection zone.

An embodiment of such an orientation is illustrated in FIG. 14B. As shown on the top of FIG. 14B, the central area (2) is filled with a protrusion. In a cross sectional view along a line (3) extending from the center (4) of the central area (2) surrounded by the loop-shaped area providing the optical effect of a loop-shaped body (1), the orientation in the loop-shaped area is the same as described above for FIG. 14A. In the area forming the protrusion in the central area, the orientation of the non-spherical magnetic or magnetizable particles (5) follows a tangent of the positively curved or the negatively curved part of a hypothetical ellipse or circle, the ellipse or circle preferably having its center along a line perpendicular to the cross-section (i.e. vertical in FIG. 14B) and located such as to extend through about the center (4) of the central area surrounded by the loop-shaped area (in the bottom of FIG. 14B, only the part of the protrusion from the center to the area outside the loop-shaped area is shown). Further, the longest or shortest axis of the hypothetical ellipse or the diameter of the hypothetical circle is preferably about the same as the diameter of the protrusion, so that the orientation of the longest axis of the non-spherical particles at the center of the protrusion is substantially parallel to the plane of the OEL, and substantially perpendicular to the plane of the OEL at the boundary of the protrusion. Again, the rate of change in orientation may be constant in such a cross-sectional view (the orientation of the particles follows a tangent to a circle) or may vary (the orientation of the particles follows an ellipse).

The dynamic loop-shaped body is thus filled with a central effect image element (i.e. a "protrusion") that can be a solid-circle of a half-sphere, e.g. in the case the loop-shaped body forms a circle, or which can have a triangular basis in the case the case of a triangular loop. In such embodiments, the outer peripheral shape of the protrusion preferably follows the form of the loop-shape (e.g. the protrusion is a solid circle or half-sphere when the loop-shaped body is a ring, and the protrusion is a solid triangle or a triangular pyramid in case the loop-shaped body is a hollow triangle). According to one embodiment of the present invention, at least a part of the outer peripheral shape of the protrusion is similar to the shape of the loop-shaped body and preferably, the loop-shaped body has the form of a ring, and the protrusion has the shape of a solid circle or half-sphere. Further, the protrusion preferably occupies about at least 20% of the area defined by the inner boundary of the loop-shaped body, more preferably about at least 30%, and most preferably about at least 50%.

Preferably, the orientation of the non-spherical particles in the protrusion and in the looped shaped area is the same. That is, in a cross-sectional view as explained above and shown in the lower part of FIG. 14B, in both of the areas forming the optical impression of the loop-shaped body and the protrusion, the particles either follow in both areas a tangent of a negatively curved part, or in both areas follow a positively curved part, of hypothetical circles or ellipses having their respective center in a vertical line extending from about the center of the respective area (the center of the central area and the center of the width of the looped-shaped area), as shown in FIG. 14B.

Another aspect of the invention described herein relates to magnetic-field-generating devices for producing an optical effect layer (OEL) as described herein, said device comprising one or more magnets and being configured for receiving a coating composition comprising the non-spherical magnetic or magnetizable particles and the binder material or for receiving a substrate on which the coating composition comprising the non-spherical magnetic or magnetizable particles and the binder material is provided, whereupon said orienting of the magnetic or magnetizable particles for the formation of the optical effect layer (OEL) is to be effected. Because the non-spherical magnetic or magnetizable particles within the coating composition, which is in a fluid state and wherein the particles are rotatable/orientable prior to the hardening of the coating composition, align themselves along the field lines as described herein above, the achieved respective orientation of the particles (i.e. their magnetic axis in the case of magnetic particles or their greatest dimension in the case of magnetizable particles) coincides, at least on average, with the local direction of the magnetic field lines at the positions of the particles. Alternatively, the magnetic-field-generating devices described herein may be used to provide a partial OEL, i.e. a security feature displaying part or parts of a loop-shape such as for example a ½ circle, a ¼ circle, etc.

Figure 5:
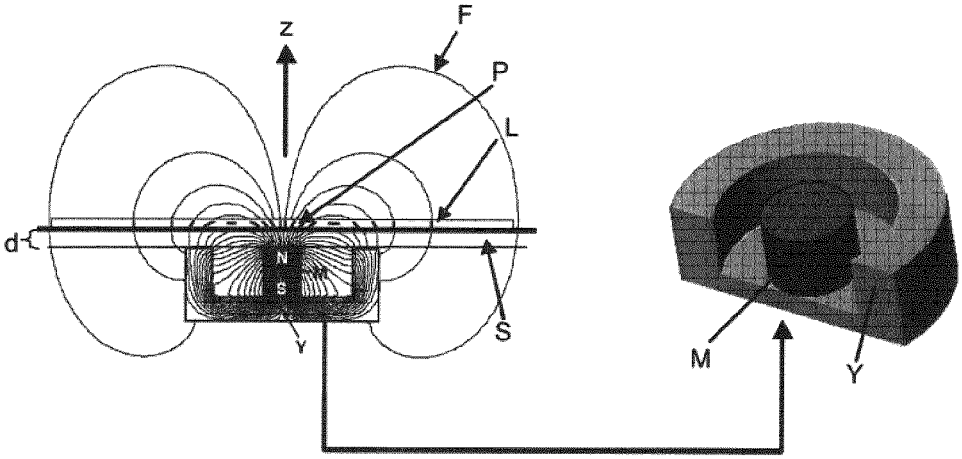
FIG. 5 schematically illustrates the structure of a magnetic-field-generating device for producing an OEL according to a third exemplary embodiment.

As illustrated for example in FIG. 5, typically a supporting surface (S), above which a layer (L) of the coating composition in a fluid state (prior to hardening) and comprising the plurality of non-spherical magnetic or magnetizable particles (P) is provided, is positioned at a given distance (d) from the poles of the magnet(s) (M) and is exposed to the average magnetic field of the device.

Such a supporting surface of the magnetic-field-generating device may be a part of a magnet that is part of the magnetic-field-generating device. In such an embodiment, the coating composition can be directly applied to the supporting surface (the magnet), on which the orientation of the non-spherical magnetic or magnetizable particles takes place. After orienting or simultaneously with the orientation, the binder material is converted to a second state (e.g. by irradiation in case of a radiation curable composition), forming a hardened film that can be peeled off the supporting surface of the magnetic-field-generating device. Thereby, an OEL in the form of a film or sheet can be produced, wherein the oriented/aligned non-spherical particles are fixed in a binder material (typically a transparent polymeric material in this case).

Alternatively, the supporting surface of the magnetic-field-generating device of the present invention is formed by a thin (typically less than 0.5 mm thickness, such as 0.1 mm thickness) plate made from a non-magnetic material, such as a polymeric material or a metal plate made from a non-magnetic material, such as for example aluminum. Such a plate forming the supporting surface is provided above the one or more magnets of the magnetic-field-generating device, as illustrated in FIG. 5. Then, the coating composition can be applied to the plate (the supporting surface), followed by orientation and hardening of the coating composition, forming an OEL in the same manner as described above.

Of course, in both embodiments above (in which the supportings surface is either part of a magnet or is formed by a plate above a magnet), also a substrate (made e.g. from paper or from any other substrate described hereafter) on which the coating composition is applied can be provided on the supporting surface, followed by orientation and hardening. Notably, the coating composition can be provided on the substrate before the substrate with the applied coating composition is placed on the supporting surface, or the coating composition can be applied on the substrate at a point in time where the substrate is already placed on the supporting surface. In either case, the layer L (i.e. the OEL) may be provided on a substrate, which is not shown in FIG. 5.

If the OEL is to be provided on a substrate, the substrate can also take the role of a supporting surface, replacing the plate. In particular if the substrate is dimensionally stable, it may not be necessary to provide e.g. a plate for receiving the substrate, but the substrate may be provided on or above the magnet without a supporting plate interposed therebetween. In the following description, the term "supporting surface", in particular with regard to the orientation of magnets in respect thereof, may in such embodiments therefore relate to a position or plane that is taken by the substrate surface without an intermediate plate being provided.

After the coating composition is provided on the supporting surface or on a substrate (either provided on a separate supporting surface (plate or magnet) or taking the role of the supporting surface), the particles (P) align with the magnetic field lines (F) of magnetic-field-generating device.

If the supporting surface is formed by a plate provided above a magnet of the magnetic-field-generating device, the distance (d) between the end of the poles of the magnet and the surface of the supporting surface (or the substrate, if the substrate is to take the place of a supporting surface) on the side where the OEL is to be formed by orientation of the particles is typically in the range between 0 (i.e. the supporting surface is a surface of a magnet and no substrate is used) to about 5 millimeters, preferably between about 0.1 and about 5 millimeters, and is selected such as to produce the appropriate dynamic loop-shaped element, according to the design needs. The supporting surface may be a supporting plate which has preferably a thickness which equals the distance (d), which allows for a mechanically solid assembly of the magnetic-field-generating device.

Differently looking dynamic loop-shaped bodies may be produced with a same magnetic-field-generating device, depending on said distance (d). Of course, if the coating composition is applied to a substrate prior to orientation of the particles on a supporting surface and the OEL is to be formed on the opposite side of the substrate with respect to the supporting surface, also the thickness of the substrate contributes to the distance between the magnet and the coating composition, in particular if the substrate takes the role of the supporting surface. Yet, typically the substrate is very thin (such as about 0.1 mm in case of a paper substrate for a banknote), so that this contribution may in practice be disregarded. However, if the contribution of the substrate cannot be disregarded, e.g. in cases where the substrate thickness is greater than 0.2 mm, the thickness of the substrate may be considered to contribute to the distance d.

Figure 3:
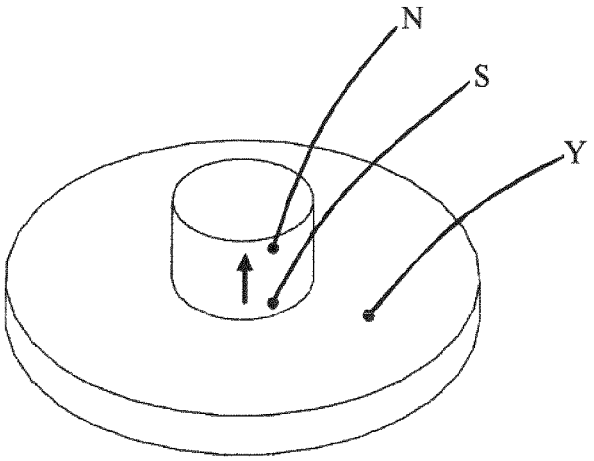
FIG. 3 schematically illustrates the structure of a magnetic-field-generating device for producing an OEL according to a first exemplary embodiment.

According to one embodiment of the present invention and as shown in FIG. 3, the magnetic-field-generating devices for producing the OEL comprises a bar dipole magnet M which is provided below a supporting surface formed by a plate or a substrate taking the role of a supporting surface and has its North-South axis perpendicular to the supporting surface. The device further comprises a pole piece Y that is disposed below the bar dipole magnet and that is in contact with one of the poles of the magnet. A pole piece denotes a structure composed of a material having high magnetic permeability, preferably a permeability between about 2 and about 1,000,000 $N \cdot A^{-2}$ (Newton per square Ampere), more preferably between about 5 and about 50,000 $N \cdot A^{-2}$ and still more preferably between about 10 and about 10,000 $N \cdot A^{-2}$. The pole piece serves to direct the magnetic field produced by a magnet, as also derivable from FIG. 5. Preferably, the pole piece described herein comprises or consists of an iron yoke (Y).

Figure 4:
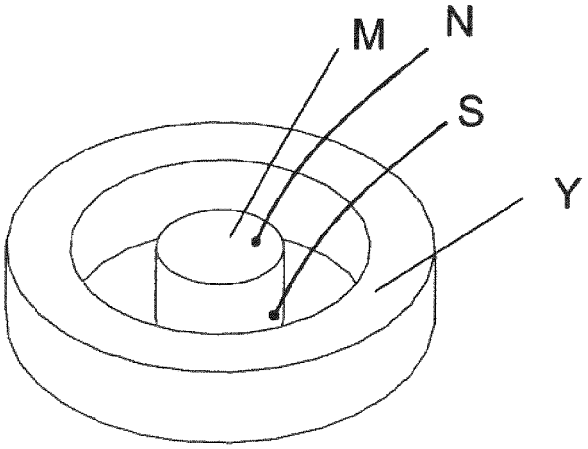
FIG. 4 schematically illustrates the structure of a magnetic-field-generating device for producing an OEL according to a second exemplary embodiment.

According to another embodiment of the present invention and as shown in FIG. 4, the magnetic-field-generating device for producing the OEL comprises a bar dipole magnet (M), which is magnetized in axial direction (i.e. has its North-South axis perpendicular to the supporting surface or the substrate surface, if no supporting surface in the form of a plate is used) and which is arranged below the supporting surface, and a pole piece (Y), preferably an iron yoke, that is spaced apart from and laterally surrounds the bar dipole magnet. Notably, the pole piece is in this embodiment only provided laterally, i.e. is not present above or below the magnet.

Alternatively and as shown in FIG. 5, the magnetic-field-generating device for producing the OEL comprises a bar dipole magnet which is magnetized in axial direction (i.e. has its North-South axis perpendicular to the supporting surface or the substrate surface, if no supporting surface in the form of a plate is used) and which is provided below the supporting surface, and a pole piece that is disposed below the bar dipole magnet and that is also laterally surrounding the bar dipole magnet. In this embodiment, the pole piece is also present below the magnet and in contact with the pole piece. The device of FIG. 5 thus combines the pole pieces of FIGS. 3 and 4.

FIG. 5 shows the cross-section of such a magnetic-field-generating device comprising a bar dipole magnet (M), which is magnetized in axial direction (i.e. has its North-South axis perpendicular to the supporting surface) and which is below the supporting surface, and a pole piece (Y) consisting of a circular U-shaped iron yoke. The magnetic field lines (F) bend downward on each side of the North- South axis of the bar dipole magnet (M), thus forming arc-shaped magnetic field line sections. The device and the three-dimensional field of the magnet (M) in space are rotationally-symmetric with respect to a central vertical axis (z). As can be deducted from the field lines, if the coating composition comprising the non-spherical magnetic or magnetizable particles is positioned directly on the supporting surface (or on a thin substrate), and the distance d is chosen as in FIG. 5, the device shown in FIG. 5 will lead to a substantially parallel orientation of the magnetic or magnetizable non-spherical particles, with respect to the surface of the OEL (i.e. the supporting surface of the device), in the area of the OEL corresponding to the space between the edges of the magnet and the pole piece. In the area of the OEL corresponding to the space directly above the magnet and directly above the pole piece, the magnetic or magnetizable non-spherical particles will adopt a substantially perpendicular orientation with respect to the surface of the OEL. Hence, the device of the FIG. 5 will lead to the formation of a loop-shaped body (a ring) surrounding a central area that is not filled with a "protrusion" and wherein only little or no reflectivity will be observed.

As illustrated for example in FIG. 6, according to another embodiment of the present invention, the magnetic-field-generating device for producing the OEL described herein comprises a dipole magnet below the supporting surface, said dipole magnet being in the form of a loop-shaped body (a ring in FIG. 6A, a triangle in FIG. 6B, a n-polygon in FIG. 6C and a pentagon in FIG. 6D) having its North-South axis directed from the central area of the loop-shaped body to the periphery when viewed from the top (the side of the supporting surface). FIG. 6 depicts a top view of such dipole magnets being loop-shaped bodies (hollow bodies) having their magnetic North-South axis directed from the center of the loop-shaped body to the periphery, or in other words dipole magnets being loop-shaped bodies (hollow bodies) and being magnetized in radial direction.

Figure 7:
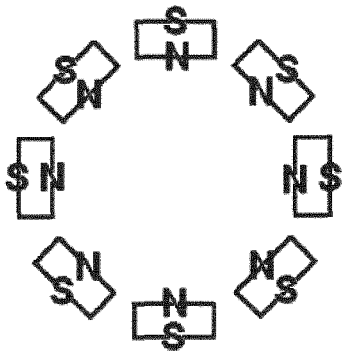
FIG. 7 schematically illustrates the structure of a magnetic-field-generating device for producing an OEL according to a sixth exemplary embodiment.

According to another embodiment of the present invention, the magnetic-field-generating device for producing the OEL described herein comprises three or more bar dipole magnets arranged below the supporting surface (or the substrate surface, if no supporting surface in the form of a plate is used), an three or more magnets being located in a static manner about a center of symmetry, each of the three or more bar dipole magnets having i) its magnetic North-South axis substantially parallel to the substrate or supporting surface, ii) its magnetic North-South axis aligned such as to be substantially radially extending from the center of symmetry and Ill) the North-South directions of said three or more magnets pointing either all towards or all away from the center of symmetry. FIG. 7 depicts a top view of a related magnetic orienting device according to an embodiment, wherein n magnets (n=8 in FIG. 7) are arranged in a plane with their magnetic axis aligned in radial direction from a central point (the center of symmetry) of the assembly of magnets (i.e. having their extended North-South axis essentially combining in a central point of the assembly of magnets). When used in the device according to the present invention, the magnetic axis is then parallel to the supporting surface. The n magnets arranged in this way can be used to produce a loop-shape in the form of an n-gon (e.g. a regular octagon in FIG. 7).

In the magnetic-field-generating device for producing the OEL as described in an illustrative manner in FIGS. 3 to 7, the loop-shaped body is formed by orienting the magnetizable or magnetic particles according to the magnetic field of a (static) loop-shaped magnetic-field-generating device in a loop-shaped area of the OEL. In other words, the optical effect of a loop-shaped body in the security element is caused by orienting the particles essentially parallel to the supporting surface or the substrate surface, if a substrate is used, and parallel to the plane of the final OEL, in accordance with the field lines of a magnetic-field-generating device that has a permanent (static) magnetic field, wherein the field lines run parallel to the supporting surface at the position where the optical impression of a loop-shaped body is to be formed. In a cross-section perpendicular to the OEL and extending from the center of the central area, the orientation of the non-spherical magnetic or magnetizable particles is thus substantially parallel to the plane of the OEL in the central portion of the "width" of the loop-shaped area, and the longest axis of the oriented particles present in the loop-shaped area forming the optical impression of a loop-shaped body follow a tangent of either a negatively curved or a positively curved part of a hypothetical ellipse or circle, such that a less parallel (and typically substantially perpendicular) orientation of the particles is obtained at the boundaries of the width of the loop-shaped area in such a cross-sectional view. Thus, in the cross-sectional view, the orientation gradually changes along the line extending from the center of the central area to the area outside the loop-shaped area. The rate of change in orientation does not need to be constant over the width of the loop-shaped area forming the optical effect of a loop-shaped body in this cross-sectional view (as is the case if the orientation of the non-spherical magnetic or magnetizable particles follows a tangent of the negatively or positively curved part of a hypothetical circle), but can vary over the width of the area forming the optical effect of a loop-shaped body. In the case of a non-constant rate of change of the orientation of the particles, the orientation of the particles follows the negatively curved part or positively curved part of a hypothetical ellipse.

Thus, in a device as illustrated in FIG. 7, the loop-shape of the loop-shaped area typically corresponds to a loop-shape in the form or arrangement of one or more magnets in the magnetic-field-generating device. For instance, in FIG. 6, the magnetic field lines connecting the North and the South pole of the magnet run parallel in an area above and below the loop-shaped magnet in ring form. Hence, in such instances the orientation of the non-spherical magnetic or magnetizable particles in the loop-shaped area forming the optical effect of a loop-shaped body can be achieved by simply providing the coating composition in a first state directly on the supporting surface or a substrate provided thereon, which is parallel to the magnetic axis of the magnet(s) of the magnetic-field-generating device in these instances, and a relative movement of the coating composition with respect to the magnets of the magnetic-field-generating device is not necessary for the desired orientation of the particles.

However, the required orientation of the non-spherical magnetic or magnetizable particles in a loop-shaped area of the OEL cannot only be achieved by a magnetic-field-generating device having such a static magnetic field. Instead, it is also possible to employ a loop-shaped movement of one or more magnet(s) of a magnetic-field-generating device relative to the supporting surface or the substrate surface (e.g. if no supporting surface in the form of a plate is used) on which the coating composition in a first state is provided (either directly or on a substrate). Further, unlike the "static" devices described above, such magnetic-field-generating devices can also be constructed in such a way that an orientation of the particles inside the central area surrounded by the loop-shaped area leading to the impression of a "protrusion" is achieved. Such devices for the formation of a loop-shaped body surrounding or not surrounding a protrusion will be described in the following.

According to one embodiment of the present invention, the magnetic-field-generating device for producing the OEL described herein comprises one or more bar dipole magnets below the supporting surface (or the substrate surface, if no supporting surface in the form of a plate is used). The one or magnets is/are provided such as to be rotatable around an axis of rotation that is substantially perpendicular to the supporting surface, the one or more bar dipole magnets having its North-South axis substantially parallel to the supporting surface/substrate surface and having its North-South axis substantially radial with respect to the axis of rotation. In the case that the magnetic-field-generating device comprises two or more magnets, their North-South directions can have the same orientation with respect to the rotational axis (i.e. the North-South direction of all magnets points towards the axis of rotation, as in FIG. 8, or away from it), or can have different orientations with respect to axis of rotation, as in FIG. 9. Here, the "same" orientation or direction with respect to the rotational axis means that the orientation of the North-South directions of the magnets is symmetric with respect to the axis of rotation.

Figure 8:
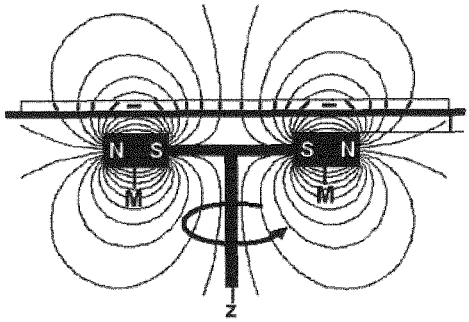
FIG. 8 schematically illustrates the structure of a magnetic-field-generating device for producing an OEL according to a seventh exemplary embodiment.

Optionally, for reasons of mechanical balance, two or more bar dipole magnets exerting a similar moment of rotational inertia can be provided symmetrically (e.g. opposite) with respect to the axis of rotation. For example, as shown in FIG. 8, magnets of a similar or same size can be symmetrically used with respect to the rotational axis (z). When the North-South direction of the second magnet has the same orientation with respect to the axis of rotation (i.e. either pointing away from or towards the axis of rotation) as the North-South direction of the first bar dipole magnet, the same magnetization patterns are produced in the OEL (L) on the supporting surface by the magnets upon rotation thereof around the axis of rotation.

If the magnetic-field-generating device comprises more than one magnet, it is particularly preferred that the magnets have about the same size and are provided in about the same distance from the axis of rotation. In this case, since the pathways of the magnets below the supporting surface are about identical when the magnets revolve around the axis of rotation, the desired orientation of the non-spherical magnetic or magnetizable particles in a loop-shaped area of the OEL can be achieved by providing the coating composition in a first state on the supporting surface of the magnetic-field-generating device and rotating the magnets around the axis of rotation.

FIG. 8 shows one example of such a magnetic-field-generating device comprising two bar dipole magnets (M) that are rotatable in a plane around a mechanical axis (z). The bar dipole magnets have i) their North-South axis in said plane, which is typically ii) substantially parallel to the supporting surface of the magnetic-field-generating device. In FIG. 8, the magnets iii) have their magnetic axes substantially radial with respect to the axis of rotation (z), with iv) the North-South direction pointing in the same direction with respect to the axis of rotation (i.e. the North-South directions are symmetrical with respect to the axis of rotation, both pointing inwards towards the axis of rotation). Further, v) the magnets have about the same size and are provided substantially symmetrically in about the same distance from the axis of rotation. The average magnetic field produced by the bar dipole magnets is rotationally symmetric with respect to said axis (z). As can be seen from the field lines in FIG. 8, upon rotation of the magnets around the axis of rotation, this device leads to the formation of a loop-shaped element in the form a ring not including a protrusion by time-dependently forming a suitable magnetic field.

Notably, the same orientation of the particles in a loop-shaped area would be obtained in case the North-South direction of each of the two magnets in FIG. 8 would be inverted (so that the North-South direction of each magnet points away from the axis of rotation). This is therefore an alternative embodiment of the magnetic-field-generating device of the present invention.

If the magnetic-field-generating device is constructed such that the distance of the one or more magnets from the axis of rotation is fixed (e.g. by providing a simple bar between the magnets and the shaft forming the axis of rotation), and furthermore, in the case of two or more magnets, the magnets have about the same size and provided at about the same distance from the axis of rotation, the loop-shaped body would necessarily take the shape of a ring (because the pathway of the magnets below the supporting surface of the magnetic-field-generating device follows a circle, and therefore the shape of the loop-shaped area is a circle). If it is however desired to form loop-shaped bodies other than a ring, such as an oval, a rectangle having rounded corners, a bone-like shape or similar, this can be achieved by constructing the device such that the pathway of the magnets below the supporting surface resembles the desired shape of the corresponding loop-shaped area. In this case, it may be desirable to construct the device such that the distance of the magnets from the axis of rotation changes upon revolution around the axis of rotation, e.g. by providing a camshaft-type structure around which the rotation takes place.

The magnetic-field-generating devices described above, having magnets that are provided rotatable around an axis of rotation, are designed such as to produce the optical effect of loop-shaped bodies by orienting the magnetic or magnetizable particles in a loop-shaped area of an OEL, wherein at least a part of the particles are oriented essentially parallel to the plane of the OEL, thereby providing reflection in a direction perpendicular to the plane of the OEL when irradiated from this direction (or under diffuse light), and otherwise follow a tangent of either a negatively curved or a positively curved part of a hypothetical circle or ellipse, as explained above. The loop-shaped areas provided by these devices surround one central area, which may or may not contain the non-spherical magnetic or magnetizable particles. If the particles are contained in said central area, they are typically oriented such as to be perpendicular to the plane of the OEL (so that no or only very little reflection of light takes place in the direction perpendicular to the plane of the OEL when irradiated from this direction), as described above, forming no "protrusion".

However, in a preferred aspect, the present invention also relates to magnetic-field-generating devices for producing OELs that further comprise a "protrusion" within the central area surrounded by the loop-shaped area. Such devices comprise a supporting surface for receiving the coating composition (directly or on a substrate) in a first state, comprising the non-spherical magnetic or magnetizable particles and the binder material, whereupon said optical effect layer is to be produced. Magnetic-field-generating devices for producing OELs further comprising a protrusion described herein comprise more than one magnet (e.g. 2, 3, 4 or more magnets) below the supporting surface. These are rotatable around an axis of rotation that is substantially perpendicular to the supporting surface.

Figure 9:
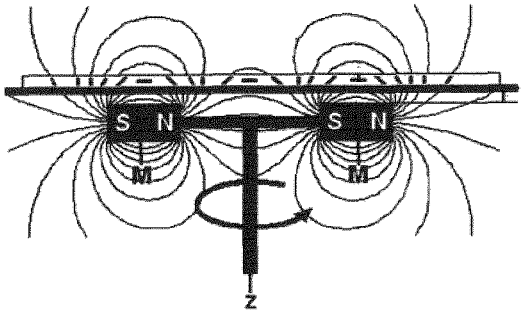
FIG. 9 schematically illustrates the structure of devices for producing an OEL further comprising a protrusion according to a first exemplary embodiment.

According to one such embodiment of the present invention, the magnetic-field-generating device for producing OELs further comprising a protrusion comprises one or more pairs of bar dipole magnets. The magnets forming the one or more pairs of magnets are provided below the supporting surface and are provided rotatable around an axis of rotation that is substantially perpendicular to the supporting surface. Each of the one or more pairs of magnets consists of an assembly of two bar dipole magnets that are located apart an axis of rotation. The bar dipole magnets of a given pair have their North-South axis radial with respect to the axis of rotation and further have their North-South direction being asymmetrical with respect to the axis of rotation and pointing in different directions with respect to the axis of rotation (one pointing towards the axis of rotation, one pointing away). Preferably, the magnets forming a pair of magnets are provided in about the same distance from the axis of rotation. As shown in FIG. 9, the one or more pairs of bar dipole magnets (M) of the magnetic-field-generating device have i) their magnetic axis substantially parallel to the supporting surface (formed by a plate in FIG. 9), ii) their magnetic axis substantially radial with respect to the axis of rotation (z) and iii) different directions of their North-South direction with respect to the axis of rotation (towards the axis of rotation in the right magnet in FIG. 9 and away from the axis of rotation in the left magnet in FIG. 9).

According to another embodiment of the present invention, the magnetic-field-generating device for producing OELs further comprising a protrusion comprises one or more pairs of bar dipole magnets that are provided below a supporting surface formed by a plate or by a substrate taking the role of a supporting surface (i.e. replacing the supporting surface), and are rotatable around an axis of rotation that is substantially perpendicular to the supporting surface. Each of the one or more pairs consists of an assembly of two bar dipole magnets which are located apart the axis of rotation, preferably in about the same distance from the axis of rotation. The dipole magnets are preferably provided directly opposite to each other with the axis of rotation as a center. Further, as illustrated in FIG. 10, unlike in the embodiments described above for forming the optical effect of a loop-shaped body not comprising a protrusion, in the present embodiment of the device for forming a loop-shaped body surrounding a protrusion, the magnetic axis of the bar dipole magnets is not aligned substantially parallel to the supporting surface or substrate but substantially perpendicular to the supporting surface or substrate.

Figure 10:
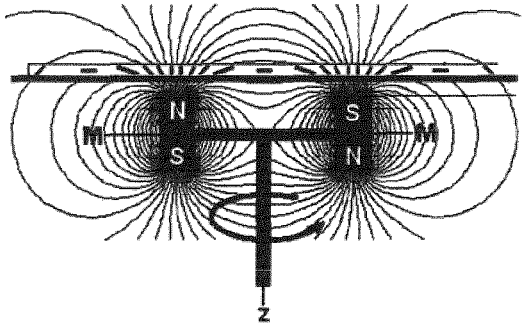
FIG. 10 schematically illustrates the structure of devices for producing an OEL further comprising a protrusion according to a second exemplary embodiment.

One preferred embodiment of such a device is shown in FIG. 10. As shown in FIG. 10, the one or more pairs of bar dipole magnets (M) of the magnetic-field-generating device have i) their North-South axis substantially perpendicular to the supporting surface or substrate, ii) their North-South axis substantially parallel to the axis of rotation (z), and iii) opposite magnetic North-South directions (one up, one down in FIG. 10).

Figure 11:
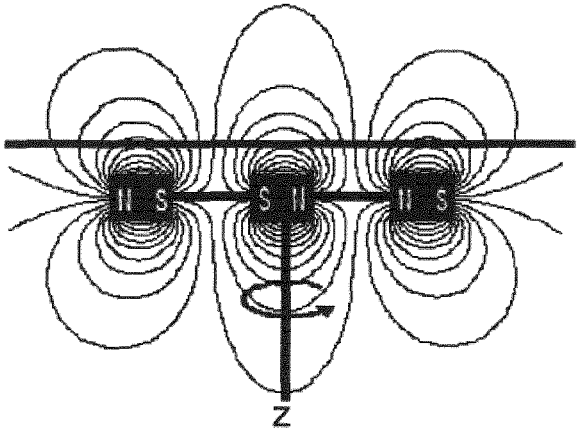
FIG. 11 schematically illustrates the structure of devices for producing an OEL further comprising a protrusion according to a third exemplary embodiment.

According to another embodiment of the magnetic-field-generating device for forming OELs further comprising a protrusion of the present invention as illustrated in FIG. 11, the device comprises an assembly of three bar dipole magnets provided below a supporting surface formed by a plate or a substrate taking the role thereof, and the magnets are rotatable around an axis of rotation that is substantially perpendicular to the supporting surface. The magnetic axis of each of the three magnets is substantially parallel to the supporting surface. Two of the three bar dipole magnets are located on opposite sides and about the axis of rotation, preferably in about the same distance from the axis of rotation, have their North-South axis substantially radial with respect to the axis of rotation and have identical North-South directions (i.e. opposite or asymmetrical with respect to the axis of rotation, one pointing towards the axis of rotation and one away). The third bar dipole magnet is provided between the two other magnets that are provided in a distance from the axis of rotation, and preferably the third magnet is provided on the axis of rotation (i.e. the axis of rotation extends through the third magnet, preferably through the center thereof). Each of the three magnets has its North-South axis substantially parallel to the supporting surface, ii) the two magnets spaced apart from the axis of rotation have their North-South axis substantially radial with respect to the axis of rotation, iii) the two bar dipole magnets spaced apart from the axis of rotation have asymmetric North-South directions (i.e. opposite with respect to the axis of rotation), and iv) the third bar dipole magnet on the axis of rotation has a North-South direction opposite to the North-South direction of the two bar dipole magnets spaced apart (see FIG. 11).

As shown in FIG. 11, the three bar dipole magnets have their magnetic axis substantially parallel to the supporting surface, the three bar dipole magnets have their magnetic axis substantially radial to the axis of rotation and substantially parallel to the supporting surface, the two bar dipole magnets provided apart from the axis of rotation have opposite magnetic North-South directions with respect to the axis of rotation (i.e. asymmetric North-South directions), and the third bar dipole magnet is provided on the axis of rotation and has its North-South direction pointing in the opposite direction to the North-South direction of the bar dipole magnet whose North-South direction is pointing towards the axis of rotation.

In analogy with the static magnetic-field-generating devices described herein, the rotatable magnetic-field-generating devices described herein may further comprise one or more additional pole pieces.

As known by the man skilled in the art, the speed and the number of rotation per minutes used for the rotatable magnetic-field-generating devices described herein is adjusted so that to orient the non-spherical magnetic or magnetizable particles as described herein, i.e. to follow a tangent of either a negatively curved or a positively curved part of a hypothetical circle.

The magnets of the magnetic-field-generating devices described herein may comprise or consist of any permanent-magnetic (hard-magnetic) material, for example of Alnico alloy, barium- or strontium-hexaferrite, cobalt alloys, or rare-earth-iron alloys such as neodymium-iron-boron alloy. Particularly preferred are, however, easily workable permanent-magnetic composite materials that comprise a permanent-magnetic filler, such as strontium-hexaferrite ($SrFe_{12}O_{19}$) or neodymium-iron-boron ($Nd_2Fe_{14}B$) powder, in a plastic- or rubber-type matrix.

Also described herein are rotating printing assemblies comprising the magnetic-field-generating devices for producing the OEL described herein, said magnetic-field-generating devices being fitted and/or inserted on the printing cylinder as a part of the rotating printing machine. In such a case, the magnetic-field-generating devices is correspondingly designed and adapted to the cylindrical surface of the rotating unit in order to assure a smooth contact with the surface to be imprinted.

Also described herein are processes for producing the OEL described herein, said processes comprising the steps of:

a) applying on a supporting surface or preferably a substrate provided on a supporting surface or taking the role of a supporting surface, a coating composition in a first (fluid) state comprising a binder material and a plurality of non-spherical magnetic or magnetizable particles described herein, b) exposing the coating composition in a first state to the magnetic field of the magnetic-field-generating device, thereby orienting the non-spherical magnetic or magnetizable particles within the coating composition; and c) hardening the coating composition to a second state so as to fix the magnetic or magnetizable non-spherical particles in their adopted positions and orientations.

The applying step a) is preferably a printing process selected from the group consisting of copperplate intaglio printing, screen printing, gravure printing, flexography printing and roller coating and more preferably from the group consisting of screen printing, gravure printing and flexography printing. These processes are well-known to the skilled man and are described for example in Printing Technology, J. M. Adams and P. A. Dolin, Delmar Thomson Learning, $5^{th}$ Edition.

While the coating composition comprising the plurality of non-spherical magnetic or magnetizable particles described herein is still wet or soft enough so that the non-spherical magnetic or magnetizable particles therein can be moved and rotated (i.e. while the coating composition is in a first state), the coating composition is subjected to a magnetic field to achieve orientation of the particles. The step of magnetically orienting the non-spherical magnetic or magnetizable particles comprises a step of exposing the applied coating composition, while it is "wet" (i.e. still liquid and not too viscous, that is, in a first state), to a determined magnetic field generated at or above a supporting surface of the magnetic-field-generating device described herein, thereby orienting the non-spherical magnetic or magnetizable particles along the field lines of the magnetic field such as to form an orientation pattern in loop-shape. In this step, the coating composition is brought sufficiently close to or in contact with the supporting surface of the magnetic-field-generating device.

When bringing the coating composition close to the supporting surface of the magnetic-field-generating device and the OEL is to be formed on one side of a substrate, the side of the substrate carrying the coating composition may face the side of the device where the one or more magnets are provided, or the side of the substrate not carrying the coating composition may face side where the magnets are provided. In the event that the coating composition is applied onto only one surface of the substrate or is applied on both sides, and a side on which the coating composition is applied is oriented such as to face the side where the magnets are provided, it is preferred that no direct contact with the supporting surface is established in case the supporting surface is part of a magnet or is formed by a plate (the substrate is only brought sufficiently close to, but not in contact with, the magnet or plate forming a supporting surface of the device). If the substrate takes the role of a supporting surface, it is preferred that a gap corresponding to the distance d between the substrate and the magnets remains.

Noteworthy, the coating composition may practically be brought into contact with the supporting surface of the magnetic-field-generating device. Alternatively, a tiny air gap, or an intermediate separating layer may be provided. In a further and preferred alternative, the method may be performed such that the substrate surface not carrying the coating composition may be brought into direct contact with the one or more magnet (i.e. the magnet(s) form the supporting surface).

If desired, a primer layer may be applied to the substrate prior to the step a). This may enhance the quality of a magnetically transferred particle orientation image or promote adhesion. Examples of such primer layers may be found in WO 2010/058026 A2.

The step of exposing the coating composition comprising the binder material and the plurality of non-spherical magnetic or magnetizable particles to a magnetic field (step b)) can be performed either simultaneously with the step a) or subsequently to the step a). That is, steps a) and b) may be performed simultaneously or subsequently.

The processes for producing the OEL described herein comprise, concomitantly to step (b) or subsequently to step (b), a step of hardening (step c)) the coating composition so as to fix the magnetic or magnetizable non-spherical particles in their adopted positions and orientations, thereby transforming the coating composition to a second state. By this fixing, a solid coating or layer is formed. The term "hardening" refers to processes including the drying or solidifying, reacting, curing, cross-linking or polymerizing the binder components in the applied coating composition, including an optionally present cross-linking agent, an optionally present polymerization initiator, and optionally present further additives, in such a manner that an essentially solid material that strongly adheres to the substrate surface is formed. As mentioned hereabove, the hardening step (step c)) may be performed by using different means or processes depending on the binder material comprised in the coating composition that also comprises the plurality of non-spherical magnetic or magnetizable particles.

The hardening step generally may be any step that increases the viscosity of the coating composition such that a substantially solid material adhering to the supporting surface is formed. The hardening step may involve a physical process based on the evaporation of a volatile component, such as a solvent, and/or water evaporation (i.e. physical drying). Herein, hot air, infrared or a combination of hot air and infrared may be used. Alternatively, the hardening process may include a chemical reaction, such as a curing, polymerizing or cross-linking of the binder and optional initiator compounds and/or optional cross-linking compounds comprised in the coating composition. Such a chemical reaction may be initiated by heat or IR irradiation as outlined above for the physical hardening processes, but may preferably include the initiation of a chemical reaction by a radiation mechanism including without limitation Ultraviolet-Visible light radiation curing (hereafter referred as UV-Vis curing) and electronic beam radiation curing (E-beam curing); oxypolymerization (oxidative reticulation, typically induced by a joint action of oxygen and one or more catalysts, such as cobalt-containing and manganese-containing catalysts); cross-linking reactions or any combination thereof.

Radiation curing is particularly preferred, and UV-Vis light radiation curing is even more preferred, since these technologies advantageously lead to very fast curing processes and hence drastically decrease the preparation time of any article comprising the OEL described herein. Moreover, radiation curing has the advantage of producing an instantaneous increase in viscosity of the coating composition after exposure to the curing radiation, thus minimizing any further movement of the particles. In consequence, any loss of information after the magnetic orientation step can essentially be avoided. Particularly preferred is radiation-curing by photo-polymerization, under the influence of actinic light having a wavelength component in the UV or blue part of the electromagnetic spectrum (typically 300 nm to 550 nm; more preferably 380 nm to 420 nm; "UV-visible-curing"). Equipment for UV-visible-curing may comprise a high-power light-emitting-diode (LED) lamp, or an arc discharge lamp, such as a medium-pressure mercury arc (MPMA) or a metal-vapor arc lamp, as the source of the actinic radiation. The hardening step (step c)) can be performed either simultaneously with the step b) or subsequently to the step b). However, the time from the end of step b) to the beginning of step c) is preferably relatively short in order to avoid any de-orientation and loss of information. Typically, the time between the end of step b) and the beginning of step c) is less than 1 minute, preferably less than 20 seconds, further preferably less than 5 seconds, even more preferably less than 1 second. It is particularly preferable that there is essentially no time gap between the end of the orientation step b) and the beginning of the hardening step c), i.e. that step c) follows immediately after step b) or already starts while step b) is still in progress.

As outlined above, step (a) (application on the supporting surface, or preferably on a substrate surface provided on or taking the role of a supporting surface) can be performed either simultaneously with the step b) or previously to the step b) (orientation of particles by a magnetic field), and also step c) (hardening) can be performed either simultaneously with the step b) or subsequently to the step b) (orientation of particles by a magnetic field). While this may also be possible for certain types of equipment, typically not all three steps a), b) and c) are performed simultaneously. Also, steps a) and b), and steps b) and c) may be performed such that they are partly performed simultaneously (i.e. the times of performing each of the steps partly overlap, so that e.g. the hardening step c) is started at the end of the orientation step b).

With the aim of increasing the durability through soiling or chemical resistance and cleanliness and thus the circulation lifetime of security documents, or with the aim of modifying their aesthetical appearance (e.g. optical gloss), one or more protective layers may be applied on top of OEL. When present, the one or more protective layers are typically made of protective varnishes. These may be transparent or slightly colored or tinted and may be more or less glossy. Protective varnishes may be radiation curable compositions, thermal drying compositions or any combination thereof. Preferably, the one or more protective layers are radiation curable compositions, more preferable UV-Vs curable compositions. The protective layers may be applied after the formation of the OEL in step c).

Figure 1C:
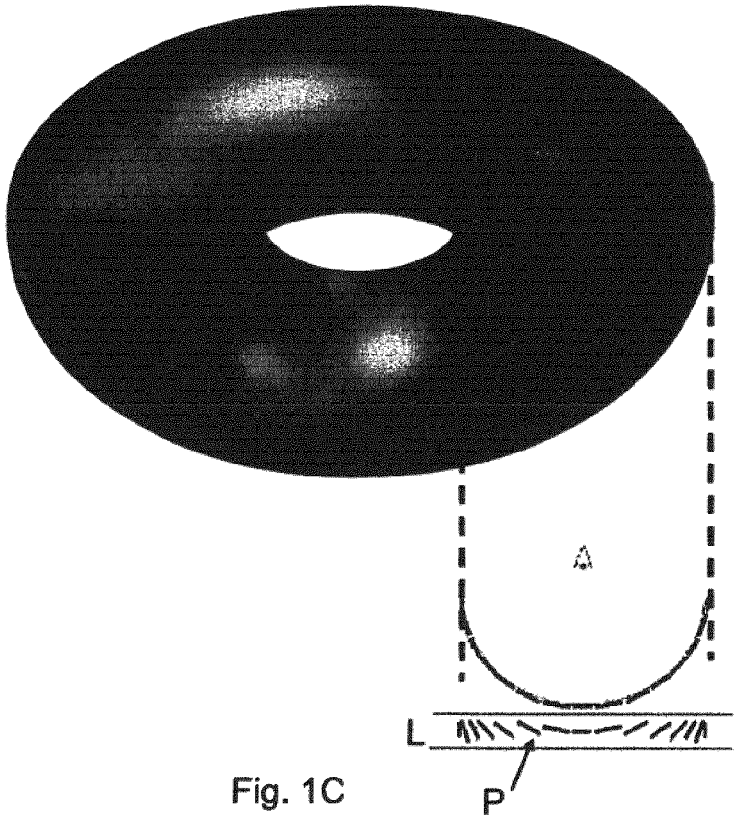

The above processes allow obtaining a substrate carrying an OEL providing the optical effect of a closed loop-shaped body surrounding one central area, wherein the non-spherical magnetic or magnetizable particles present in the loop-shaped area forming the closed shaped body follow a tangent of either the negatively curved part (see FIG. 1B) or the positively curved part (see FIG. 1C) of a hypothetical ellipse or circle, depending upon whether the magnetic field of the magnetic-field-generating device is applied from below or from above to the layer of coating composition comprising the non-spherical magnetic or magnetizable particle. Such an orientation may also be expressed such that the orientation of the longest axis of the non-spherical magnetic or magnetizable particles follows the surface of a hypothetical semi-toroidal body lying in the plane of the optical effect layer, as illustrated in FIG. 1. Further, depending on the type of equipment used, the central area surrounded by the loop-shaped body can comprise a so-called "protrusion", i.e. an area that comprises the magnetic or magnetizable particles in an orientation that is substantially parallel to the substrate surface. In such embodiments, the orientation changes towards the surrounding loop-shaped body, following either a negative or a positive curve when seen in a cross-section extending from the center of the central area to the area outside the loop-shaped body. Between the loop-shaped body and the "protrusion", there is preferably an area in which the particles are oriented substantially perpendicular to the substrate surface, showing no or only little light reflection.

This is particularly useful in applications where the OEL is formed from an ink, e.g. a security ink, or some other coating material, and is permanently disposed on a substrate like a security document, e.g. by way of printing as described above.

In the processes described above and when the OEL is to be provided on a substrate, said OEL may be provided directly on a substrate on which it shall remain permanently (such as for banknote applications). However, in an alternative embodiment of the present invention, the OEL may also be provided on a temporary substrate for production purposes, from which the OEL is subsequently removed. This may for example facilitate the production of the OEL, particularly while the binder material is still in its fluid state. Thereafter, after hardening the coating composition for the production of the OEL, the temporary substrate may be removed from the OEL. Of course, in such cases the coating composition must be in a form that is physically integral after the hardening step, such as for instances in cases where a plastic-like or sheet-like material is formed by the hardening. Thereby, a film-like transparent and/or translucent material consisting of the OEL as such (i.e. essentially consisting of oriented magnetic or magnetizable particles having non-isotropic reflectivity, hardened binder components for fixing the particles in their orientation and forming a film-like material, such as a plastic film, and further optional components) can be provided.

Alternatively, in another embodiment the substrate may comprise an adhesive layer on the side opposite the side where the OEL is provided, or an adhesive layer can be provided on the same side as the OEL and on top of the OEL, preferably after the hardening step has been completed. In such instances, an adhesive label comprising the adhesive layer and the OEL is formed. Such a label may be attached to all kinds of documents or other articles or items without printing or other processes involving machinery and rather high effort.

According to one embodiment, the OEC is manufactured in the form of a transfer foil, which can be applied to a document or to an article in a separate transfer step. To this aim, the substrate is provided with a release coating, on which an OEL is produced as described herein. One or more adhesive layers may be applied over the so produced OEL.

The substrate described herein is preferably selected from the group consisting of papers or other fibrous materials, such as cellulose, paper-containing materials, glasses, ceramics, plastics and polymers, glasses, composite materials and mixtures or combinations thereof. Typical paper, paper-like or other fibrous materials are made from a variety of fibers including without limitation abaca, cotton, linen, wood pulp, and blends thereof. As is well known to those skilled in the art, cotton and cotton/linen blends are preferred for banknotes, while wood pulp is commonly used in non-banknote security documents. Typical examples of plastics and polymers include polyolefins such as polyethylene (PE) and polypropylene (PP), polyamides, polyesters such as poly(ethylene terephthalate) (PET), poly(1,4-butylene terephthalate) (PBT), poly(ethylene 2,6-naphthoate) (PEN) and polyvinylchlorides (PVC). Spunbond olefin fibers such as those sold under the trademark Tyvek® may also be used as substrate. Typical examples of composite materials include without limitation multilayer structures or laminates of paper and at least one plastic or polymer material such as those described hereabove as well as plastic and/or polymer fibers incorporated in a paper-like or fibrous material such as those described hereabove. Of course, the substrate can comprise further additives that are known to the skilled person, such as sizing agents, whiteners, processing aids, reinforcing or wet strengthening agents etc.

Figure 12:
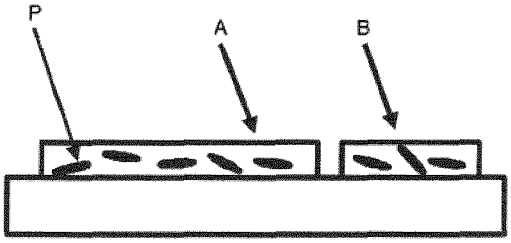
FIG. 12 schematically illustrates an optical effect coated substrate (OEC) comprising two separate optical effect layer (OEL) components (A & B) disposed on a substrate.

According to one embodiment of the present invention, the optical effect coated substrate (OEC) comprises more than one OEL on the substrate described herein, for example it may comprise two, three, etc. OELs. Herein, one, two or more OELs may be formed using a single magnetic-field-generating device, several same magnetic-field-generating devices, or may be formed by using several different magnetic-field-generating devices. FIG. 12 illustrates a cross-section of an exemplary OEC having a plurality of non-spherical magnetic or magnetizable particles (P) dispersed therein, provided on a substrate. In a cross-sectional view, the OEC described herein comprises two (A and B) OEL disposed on a substrate. The OEL A and B may or may not be connected to each other in the third dimension perpendicular to the cross-section shown in FIG. 12.

The OEC may comprise a first OEL and a second OEL, wherein both of them are present on the same side of the substrate or wherein one is present on one side of the substrate and the other one is present on the other side of the substrate. If provided on the same side of the substrate, the first and the second OEL may be adjacent or not adjacent to each other. Additionally or alternatively, one of the OELs may partially or fully superimpose the other OEL.

If more than one magnetic-field-generating device is used for producing a plurality of OELs, the magnetic-field-generating devices for orienting the plurality of non-spherical magnetic or magnetizable particles for producing one OEL and the magnetic-field-generating device for producing another OEL may be placed either i) on the same side of the substrate, so as to produce two OELs exhibiting either a negatively curved part (see FIG. 1B) or a positively curved part (see FIG. 1C), or ii) on opposite sides of the substrate so as to have one OEL exhibiting a negatively curved and the other exhibiting positively curved part. The magnetic orientation of the non-spherical magnetic or magnetizable particles for producing the first OEL and the non-spherical magnetic or magnetizable particles for producing the second OEL may be performed simultaneously or sequentially, with or without intermediate hardening or partial hardening of the binder material.

With the aim of further increasing the security level and the resistance against counterfeiting and illegal reproduction of security documents, the substrate may comprise printed, coated, or laser-marked or laser-perforated indicia, watermarks, security threads, fibers, planchettes, luminescent compounds, windows, foils, decals and combinations thereof. With the same aim of further increasing the security level and the resistance against counterfeiting and illegal reproduction of security documents, the substrate may comprise one or more marker substances or taggants and/or machine readable substances (e.g. luminescent substances, UV/visible/R absorbing substances, magnetic substances and combinations thereof).

The OEL described herein may be used for decorative purposes as well as for protecting and authenticating a security document.

The present invention also encompasses articles and decorative objects comprising the OEL described herein. The articles and decorative object may comprise more than one optical effect layers described herein. Typical examples of articles and decorative objects include without limitation luxury goods, cosmetic packagings, automotive parts, electronic/electrical appliances, furnitures, etc.

An important aspect of the present invention relates to security documents comprising the OEL described herein. The security document may comprise more than one optical effect layers described herein. Security documents include without limitation value documents and value commercial goods. Typical example of value documents include without limitation banknotes, deeds, tickets, checks, vouchers, fiscal stamps and tax labels, agreements and the like, identity documents such as passports, identity cards, visas, driving licenses, bank cards, credit cards, transactions cards, access documents or cards, entrance tickets, public transportation tickets or titles and the like. The term "value commercial good" refers to packaging materials, in particular for pharmaceutical, cosmetics, electronics or food industry, that shall be protected against counterfeiting and/or illegal reproduction in order to warrant the content of the packaging like for instance genuine drugs. Examples of these packaging materials include without limitation labels, such as authentication brand labels, tamper evidence labels and seals.

Preferably, the security document described herein is selected from the group consisting of banknotes, identity documents, right-conferring documents, driving licenses, credit cards, access cards, transportation titles, bank checks and secured product labels. Alternatively, the OEL may be produced onto an auxiliary substrate such as for example a security thread, security stripe, a foil, a decal, a window or a label and consequently transferred to a security document in a separate step.

The skilled person can envisage several modifications to the specific embodiments described above without departing from the spirit of the present invention. Such modifications are encompasses by the present invention.

Further, all documents referred to throughout this specification are hereby incorporated by reference in their entirety as set forth in full herein.

The present invention will now be described by way of Examples, which are however not intended to limit its scope in any way.

EXAMPLES

Example 1

A magnetic-field-generating device according to FIG. 5 was used to orient non-spherical optically variable magnetic pigments in a printed layer of a UV-curable screen printing ink on a black paper as the substrate.

The ink had the following formula:

| | |
|---|---|
| Epoxyacrylate oligomer | 40% |
| Trimethylolpropane triacrylate monomer | 10% |
| Tripropyleneglycol diacrylate monomer | 10% |
| Genorad 16 (Rahn) | 1% |
| Aerosil 200 (Evonik) | 1% |
| Irgacure 500 (BASF) | 6% |
| Genocure EPD (Rahn) | 2% |

-continued

| | |
|---|---|
| Non-spherical optically variable magnetic pigments (7 layers) (*) | 20% |
| Dowanol PMA | 10% |

(*) green-to-blue optically variable magnetic pigment flakes of diameter d50 about 15 μm and thickness about 1 μm, obtained from JDS-Uniphase, Santa Rosa, CA.

The magnetic-field-generating device comprised a ground plate of soft-magnetic iron, on which an axially magnetized NdFeB permanent magnetic cylinder of 5 mm diameter and 8 mm thickness was disposed, with the magnetic South Pole on the soft-magnetic ground plate. A rotationally symmetric, U-shaped soft-magnetic iron yoke of 16 mm external diameter, 12 mm internal diameter, and 8 mm depth was disposed on the magnetic North pole of the axially magnetized NdFeB permanent magnetic cylinder.

The paper substrate carrying the applied layer of a UV-curable screen printing ink was disposed at a distance of Imm from the magnetic pole of the annular permanent magnet and the iron yoke. The so obtained magnetic orientation patter of the optically variable pigments was, subsequently to the applications step, fixed by UV-curing the printed layer comprising the particles.

The resulting magnetic orientation image is given in FIG. 2A.

Example 2

A magnetic-field-generating device according to FIG. 9 was used to orient optically variable magnetic pigments in a printed layer of a UV-curable screen printing ink according to the formula of Example 1 on a black paper as the substrate.

The magnetic-field-generating device comprised two NdFeB magnets of 10 mm large, 10 mm width, and 10 mm height, spaced 15 mm from each other, having their magnetization directions along the width of 10 mm. The magnets were radially aligned about the rotation axis so that their magnetization directions were collinear. The magnets were mounted on a plate rotating at the speed of 300 rpm (rotations per minute). The paper substrate carrying the printed layer of a UV-curable screen printing ink was disposed at a distance of 0.5 mm from the surface of magnets. The so obtained magnetic orientation pattern of the optically variable pigment particles was, subsequently to the applications step, fixed by UV-curing the printed layer comprising the particles.

The resulting magnetic orientation image is given in FIG. 2B under three different views, illustrating the viewing-angle dependent change of the image.

The invention claimed is:

1. An optical effect layer (OEL) comprising:

a plurality of non-spherical magnetic or magnetizable particles, which are dispersed in a coating composition comprising a binder material, wherein in at least a loop-shaped area of the OEL at least a part of the plurality of non-spherical magnetic or magnetizable particles are oriented such that their longest axis is substantially parallel to the plane of the OEL, and wherein, in a cross-section perpendicular to the OEL and extending from the center of the central area, the longest axis of the oriented particles present in the loop-shaped area follow a tangent of either a negatively curved or a positively curved part of a hypothetical ellipse or circle; and wherein the central area surrounded by the loop-shaped area comprises a plurality of non-spherical magnetic or magnetizable particles, wherein a part of the plurality of non-spherical magnetic or magnetizable particles within the central area are oriented such that their longest axis is substantially parallel to the plane of the OEL, forming the optical effect of a protrusion within the central area of the loop-shaped area.

2. The optical effect layer (OEL) according to claim 1, wherein the OEL comprises an external area outside the closed loop-shaped area, and the external area surrounding the loop-shaped area comprises a plurality of non-spherical magnetic or magnetizable particles, wherein a part of the plurality of non-spherical magnetic or magnetizable particles within the external area are oriented such that their longest axis is substantially perpendicular to the plane of the OEL or randomly oriented.

3. The optical effect layer (OEL) according to claim 1, wherein at least a part of an outer peripheral shape of the protrusion is similar to the shape of the loop-shaped area.

4. The optical effect layer (OEL) according to claim 3, wherein the loop-shaped area has the form of a ring, and the protrusion has the shape of a solid circle or a half-sphere.

5. The optical effect layer (OEL) according to claim 1, wherein at least a part of the plurality of non-spherical magnetic or magnetizable particles comprise non-spherical optically variable magnetic or magnetizable pigments.

6. The optical effect layer (OEL) according to claim 5, wherein the non-spherical optically variable magnetic or magnetizable pigments are selected from the group consisting of magnetic thin-film interference pigments, magnetic cholesteric liquid crystal pigments and mixtures thereof.

7. An optical effect coated substrate (OEC) comprising one or more optical effect layers according to claim 1 on a substrate.

8. A security document comprising an optical effect layer recited in claim 1.

9. The security document according to claim 8 being one of a banknote or an identify document.

10. A method of forming a security document protected against counterfeiting or fraud or with a decorative application, comprising applying the optical effect layer recited in claim 1 onto the security document.

11. A magnetic-field-generating device for forming an optical effect layer, said device being configured for receiving a coating composition on a supporting surface or on a substrate, the coating composition comprising a plurality of non-spherical magnetic or magnetizable particles and a binder material, the device comprising more than one magnet below the supporting surface, the magnets being arranged rotatable around an axis of rotation that is substantially perpendicular to the supporting surface, the device being configured for orienting at least a part of the plurality of non-spherical magnetic or magnetizable particles in parallel to the plane of the optical effect layer in at least a loop-shaped area thereof, wherein, in a cross-section perpendicular to the OEL and extending from the center of the central area, the longest axis of the oriented particles present in the loop-shaped area follow a tangent of either a negatively curved or a positively curved part of a hypothetical ellipse or circle, and being configured to orient a part of the plurality of non-spherical magnetic or magnetizable particles within the central area such that their longest axis is substantially parallel to the plane of the OEL, forming the optical effect of a protrusion within the central area of the loop-shaped area.

12. The magnetic-field-generating device according to claim 11, which either a) comprises a supporting surface for receiving the coating composition, and the supporting surface is formed by a1) a plate on which the coating composition can be applied directly, a2) a plate for receiving a substrate on which the coating composition can be applied, or b) is configured for receiving a substrate on which the optical effect layer is to be provided, said substrate replacing the supporting surface.

13. The magnetic-field-generating device according to claim 11, said device comprising a supporting surface or being configured to receive a substrate replacing the supporting surface, wherein, upon rotation of the magnets around the axis of rotation, time dependently magnetic field lines that are substantially parallel to the supporting surface are generated in an area defining a loop-shape and within a central area surrounded by the loop-shape and being spaced apart from the loop-shape, the device comprising either a) one or more pairs of bar dipole magnets below the supporting surface and rotatable around an axis of rotation that is substantially perpendicular to the supporting surface, said magnets having their North-South axis substantially parallel to the supporting surface and their magnetic North-South axis substantially radial with respect to the axis of rotation and the same magnetic North-South direction the one or more pairs being each formed by two bar dipole magnets that are located substantially symmetrically about the axis of rotation;

b) one or more pairs of bar dipole magnets below the supporting surface and rotatable around an axis of rotation that is substantially perpendicular to the supporting surface, said magnets having i) their North-South axis substantially perpendicular to the supporting surface, ii) their magnetic North-South axis substantially parallel to the axis of rotation, and iii) opposite magnetic North-South directions, the one or more pairs each consisting of assemblies of two bar dipole magnets being symmetrically disposed about the axis of rotation;

c) three bar dipole magnets below the supporting surface and provided rotatable around an axis of rotation that is substantially perpendicular to the supporting surface, wherein two of the three bar dipole magnets are located on opposite sides and about the axis of rotation, and the third bar dipole magnet is positioned on the axis of rotation, and wherein i) each of the magnets has its North-South axis substantially parallel to the supporting surface, ii) the two magnets spaced apart from the axis of rotation have their North-South axis substantially radial with respect to the axis of rotation, iii) the two bar dipole magnets spaced apart from the axis of rotation have identical North-South directions asymmetric with respect to the axis of rotation, and iv) the third bar dipole magnet on the axis of rotation has a North-South direction opposite to the North-South direction of the two bar dipole magnets spaced apart.

14. The magnetic-field-generating device according to claim 13, wherein the loop-shaped area provides the optical impression of a loop-shaped area that takes the form of a ring, and the central area surrounded by the loop-shaped area provides the optical impression of a solid circle or half-sphere.

15. A printing assembly comprising the magnetic-field-generating devices recited in claim 11.

16. Use of the magnetic-field-generating devices recited in claim 11 for producing the OEL.

17. A process for producing an optical effect layer (OEL) comprising the steps of:

a) applying on a substrate surface or on a supporting surface of magnetic-field-generating device a coating composition comprising a binder and a plurality of non-spherical magnetic or magnetizable particles, said coating composition being in a first state, b) exposing the coating composition in a first state to the magnetic field of a magnetic-field-generating device, thereby orienting at least a part of the non-spherical magnetic or magnetizable particles in at least a loop-shaped area surrounding one central area such that, in a cross-section perpendicular to the OEL and extending from the center of the central area, the longest axis of the particles present in the loop-shaped area follow a tangent of either a negatively curved or a positively curved part of a hypothetical circle wherein the central area surrounded by the loop-shaped area comprises a plurality of non-spherical magnetic or magnetizable particles, wherein a part of the plurality or non-spherical magnetic or magnetizable particles within the central area are oriented such that their longest axis is substantially parallel to the plane of the OEL, forming the optical effect of a protrusion within the central area of the loop-shaped area, and c) hardening the coating composition to a second state so as to fix the magnetic or magnetizable non-spherical particles in their adopted positions and orientations.

18. The process according to claim 17, wherein the hardening step c) is done by UV-Vis light radiation curing.

19. An optical effect layer on a substrate, which is obtainable by a process in which a plurality of bar dipole magnets are arranged and rotated to expose an applied coating composition comprising a binder and a plurality of non-spherical magnetic or magnetizable particles to a magnetic field, the magnetic field over an axis of rotation of the plurality of bar dipole magnets being parallel to the substrate on which the coating composition is applied, the optical effect layer comprising:

a perceptible toroidal loop shaped portion with a perceptible protrusion located within the perceptible toroidal loop shaped portion, wherein the perceptible protrusion is formed by a portion of the plurality of non-spherical magnetic or magnetizable particles applied over the axis of rotation being oriented so that their longest axes are substantially parallel to the substrate.

* * * * *